US007893895B2

(12) United States Patent
Uchino et al.

(10) Patent No.: US 7,893,895 B2
(45) Date of Patent: Feb. 22, 2011

(54) PIXEL CIRCUIT, DISPLAY DEVICE, DRIVING METHOD OF PIXEL CIRCUIT, AND DRIVING METHOD OF DISPLAY DEVICE

(75) Inventors: Katsuhide Uchino, Kanagawa (JP); Junichi Yamashita, Tokyo (JP)

(73) Assignee: Sony Corporation, Tokyo (JP)

( * ) Notice: Subject to any disclaimer, the term of this patent is extended or adjusted under 35 U.S.C. 154(b) by 1590 days.

(21) Appl. No.: 11/171,416

(22) Filed: Jul. 1, 2005

(65) Prior Publication Data

US 2006/0022907 A1 Feb. 2, 2006

(30) Foreign Application Priority Data

Jul. 5, 2004 (JP) ..... P2004-198056
Jul. 5, 2004 (JP) ..... P2004-198057
Jul. 8, 2004 (JP) ..... P2004-201223
Jul. 23, 2004 (JP) ..... P2004-215056

(51) Int. Cl.
*G09G 3/30* (2006.01)

(52) U.S. Cl. ..... 345/78; 345/82; 345/84

(58) Field of Classification Search ..... 345/76–83, 345/87–104

See application file for complete search history.

(56) References Cited

U.S. PATENT DOCUMENTS 6,518,962 B2 2/2003 Kimura et al.
2003/0103022 A1* 6/2003 Noguchi et al. ..... 345/77

FOREIGN PATENT DOCUMENTS

JP 2003-255856 9/2003
JP 2003-271095 9/2003
WO WO-98/40871 A1 9/1998

OTHER PUBLICATIONS

Japanese Office Action issued Sep. 28, 2010 for corresponding Japanese Application No. 2004-215056.
Japanese Office Action issue Sep. 28, 2010 for corresponding Japanese Application No. 2004-198056.

* cited by examiner

*Primary Examiner*—Amr Awad
*Assistant Examiner*—Michael Pervan
(74) *Attorney, Agent, or Firm*—Rader, Fishman & Grauer PLLC

(57) ABSTRACT

A pixel circuit, disposed at a part where a scanning line and a signal line intersect each other, includes at least an electrooptic element, a drive transistor, a sampling transistor, and a retaining capacitance. The drive transistor has a gate connected to an input node, a source connected to an output node, and a drain connected to a predetermined power supply potential and supplies a driving current to the electrooptic element according to a signal potential retained in the retaining capacitance. The electrooptic element has one terminal connected to the output node and another terminal connected to a predetermined potential. The sampling transistor is connected between the input node and the signal line and operates when selected by the scanning line, samples an input signal from the signal line, and retains the input signal in the retaining capacitance. The retaining capacitance is connected to the input node. The pixel circuit further includes a compensating circuit which detects a decrease in the driving current from a side of the output node and feeds back a result of detection to a side of the input node to compensate for a decrease in the driving current, which decrease is attendant on a secular change of the drive transistor.

4 Claims, 15 Drawing Sheets

Background Art

Background Art

Background Art

Background Art

Background Art

Background Art

Background Art

PIXEL CIRCUIT, DISPLAY DEVICE, DRIVING METHOD OF PIXEL CIRCUIT, AND DRIVING METHOD OF DISPLAY DEVICE

BACKGROUND OF THE INVENTION

The present invention relates to a pixel circuit that performs current driving of a load element disposed in each pixel. The present invention also relates to a display device having such pixel circuits arranged in the form of a matrix, and particularly to a so-called active matrix type display device that controls an amount of current passed through a load element such as an organic EL light emitting element or the like by an insulated gate type electric field effect transistor provided within each pixel circuit.

An image display device, for example, a liquid crystal display, has a large number of liquid crystal pixels arranged in the form of a matrix and displays an image by controlling the intensity of transmitted or reflected incident light in each pixel according to image information to be displayed. While this is true for an organic EL display using an organic EL element in a pixel or the like, the organic EL element is a self light emission element unlike a liquid crystal pixel. Thus, the organic EL display has advantages of, for example, higher image visibility, no need for a backlight, and higher response speed as compared with a liquid crystal display. The brightness level (gradation) of each light emitting element can be controlled by the value of a current flowing through the light emitting element. The organic EL display differs greatly from the liquid crystal display and the like in that the organic EL display is of a so-called current control type.

As with the liquid crystal display, there is a simple matrix system and an active matrix system as the driving system of the organic EL display. The former system offers a simple structure but presents, for example, a problem of difficulty in the realization of a large and high-definition display. Therefore, development in the active matrix system is now being actively performed. This system controls a current flowing through a light emitting element within each pixel circuit by an active element (commonly a thin-film transistor (TFT)) provided within the pixel circuit. The active matrix system is described in the following documents.

[Patent Document 1]

Japanese Patent Laid-Open No. 2003-255856

[Patent Document 2]

Japanese Patent Laid-Open No. 2003-271095

Pixel circuits are disposed at respective parts where scanning lines, in the form of rows, and signal lines, in the form of columns, intersect each other in related art. Each pixel circuit includes at least a thin-film type sampling transistor, a retaining capacitance, a thin-film type drive transistor, and a load element such as a light emitting element or the like. The sampling transistor conducts between the source and the drain of the sampling transistor when the gate of the sampling transistor is selected by a scanning line and samples a video signal from a signal line. The sampled signal is written to the retaining capacitance and then retained by the retaining capacitance. The gate of the drive transistor is connected to the retaining capacitance, and one of the source and the drain of the drive transistor is connected to the load element such as a light emitting element or the like. The gate of the drive transistor receives a source-reference gate voltage based on the signal potential retained in the retaining capacitance. The drive transistor passes a current between the source and the drain according to the gate voltage, and thus passes the current through the light emitting element. The brightness of the light emitting element is generally proportional to the amount of current passed through the light emitting element. Further, the amount of current passed by the drive transistor is controlled by the gate voltage, that is, the signal potential written to the retaining capacitance. The light emitting element thus emits light at a brightness corresponding to the video signal.

The operation characteristic of the drive transistor is expressed by the following equation:

$$Ids=(1/2)\mu(W/L)Cox(Vgs-Vth)^2$$

In the transistor characteristic equation, Ids denotes a drain current. Vgs denotes a voltage applied to the gate with the source as a reference. Vth denotes a threshold voltage of the transistor. Another symbol μ denotes the mobility of a semiconductor thin film forming a channel in the transistor. W denotes a channel width. L denotes a channel length. Cox denotes a gate capacitance. As is clear from this transistor characteristic equation, when the thin-film transistor operates in a saturation region and the gate voltage Vgs becomes higher than the threshold voltage Vth, the thin-film transistor is brought into an on state, and thus the drain current Ids flows. As is clear from the above transistor characteristic equation, when the gate voltage Vgs is constant, the same amount of drain current Ids should always flow through the light emitting element. However, there is a problem in that degradation in brightness occurs with the passage of time.

SUMMARY OF THE INVENTION

According to an embodiment of the present invention, there is provided a pixel circuit disposed at a part where a scanning line and a signal line intersect each other, the pixel circuit including at least: an electrooptic element; a drive transistor; a sampling transistor; a retaining capacitance; the drive transistor having a gate connected to an input node, a source connected to an output node, and a drain connected to a predetermined power supply potential; the electrooptic element having one terminal connected to the output node and another terminal connected to a predetermined potential; the sampling transistor being connected between the input node and the signal line; the retaining capacitance being connected to the input node; the sampling transistor operating when selected by the scanning line, sampling an input signal from the signal line, and retaining the input signal in the retaining capacitance; the drive transistor supplying a driving current to the electrooptic element according to a signal potential retained in the retaining capacitance; and a compensating circuit to compensate for a decrease in the driving current which decrease is attendant on a secular change of the drive transistor; the compensating circuit detecting a decrease in the driving current from a side of the output node and feeding back a result of detection to a side of the input node.

Preferably, the compensating circuit detects a voltage drop occurring in the electrooptic element, according to the driving current from the side of the output node, obtains a difference by comparing a level of the input signal with a level of the detected voltage drop, and adds a potential corresponding to the difference to the signal potential retained in the retaining capacitance. Specifically, the compensating circuit includes: a detecting capacitance connected between the output node and a predetermined intermediate node; a switching transistor inserted between the intermediate node and the signal line; a switching transistor inserted between a terminal node connected to one terminal of the retaining capacitance and a predetermined ground potential; a switching transistor inserted between the terminal node and the output node; and a switching transistor inserted between the terminal node and the intermediate node.

The present invention also incorporates a display device including scanning lines in a form of rows, signal lines in a form of columns, and pixel circuits arranged in a form of a matrix at parts where the scanning lines intersect the signal lines. Each pixel circuit includes at least an electrooptic element, a drive transistor, a sampling transistor, and a retaining capacitance; the drive transistor has a gate connected to an input node, a source connected to an output node, and a drain connected to a predetermined power supply potential; the electrooptic element has one terminal connected to the output node and another terminal connected to a predetermined potential; the sampling transistor is connected between the input node and the signal line; the retaining capacitance is connected to the input node; the sampling transistor operates when selected by the scanning line, samples an input signal from the signal line, and retains the input signal in the retaining capacitance; and the drive transistor supplies a driving current to the electrooptic element according to a signal potential retained in the retaining capacitance, whereby display is made. As a feature, the pixel circuit further includes a compensating circuit for compensating for a decrease in the driving current, which decrease is attendant on a secular change of the drive transistor. The compensating circuit detects a decrease in the driving current from a side of the output node and feeds back a result of detection to a side of the input node.

Preferably, the compensating circuit detects a voltage drop occurring in the electrooptic element, according to the driving current from the side of the output node, obtains a difference by comparing a level of the input signal with a level of the detected voltage drop, and adds a potential corresponding to the difference of the signal potential retained in the retaining capacitance. Specifically, the compensating circuit includes: a detecting capacitance connected between the output node and a predetermined intermediate node; a switching transistor inserted between the intermediate node and the signal line; a switching transistor inserted between a terminal node connected to one terminal of the retaining capacitance and a predetermined ground potential; a switching transistor inserted between the terminal node and the output node; and a switching transistor inserted between the terminal node and the intermediate node.

According to another embodiment of the present invention, there is provided a driving method of a pixel circuit disposed at a part where a scanning line and a signal line intersect each other, the pixel circuit including at least an electrooptic element, a drive transistor, a sampling transistor, and a retaining capacitance, the drive transistor having a gate connected to an input node, a source connected to an output node, and a drain connected to a predetermined power supply potential, the electrooptic element having one terminal connected to the output node and another terminal connected to a predetermined potential, the sampling transistor being connected between the input node and the signal line, the retaining capacitance being connected to the input node, the driving method including the steps of: the sampling transistor operating when selected by the scanning line, sampling an input signal from the signal line, and retaining the input signal in the retaining capacitance; the drive transistor supplying a driving current to the electrooptic element according to a signal potential retained in the retaining capacitance and compensating for a decrease in the driving current which decrease is attendant on a secular change of the drive transistor by detecting the decrease in the driving current from a side of the output node and feeding back a result of detection to a side of the input node.

According to another embodiment of the present invention, there is provided a driving method of a display device, the display device including scanning lines in a form of rows, signal lines in a form of columns, and pixel circuits arranged in a form of a matrix at parts where the scanning lines intersect the signal lines, the pixel circuits each including at least an electrooptic element, a drive transistor, a sampling transistor, and a retaining capacitance, the drive transistor having a gate connected to an input node, a source connected to an output node, and a drain connected to a predetermined power supply potential, the electrooptic element having one terminal connected to the output node and another terminal connected to a predetermined potential, the sampling transistor being connected between the input node and the signal line, the retaining capacitance being connected to the input node, the driving method including the steps of: when the sampling transistor operates when selected by the scanning line, samples an input signal from the signal line, and retains the input signal in the retaining capacitance, and the drive transistor supplies a driving current to the electrooptic element according to a signal potential retained in the retaining capacitance, whereby display is made, compensating for a decrease in the driving current which decrease is attendant on a secular change of the drive transistor by detecting the decrease in the driving current from a side of the output node, and feeding back a result of detection to a side of the input node.

According to another embodiment of the present invention, there is provided a pixel circuit disposed at a part where a scanning line and a signal line intersect each other, the pixel circuit including at least: an electrooptic element; a drive transistor; a sampling transistor; a retaining capacitance; the drive transistor having a gate connected to an input node, a source connected to an output node, and a drain connected to a predetermined power supply potential; the electrooptic element having one terminal connected to the output node and another terminal connected to a predetermined potential; the sampling transistor being connected between the input node and the signal line; the retaining capacitance being connected to the input node; the sampling transistor operating when selected by the scanning line, sampling an input signal from the signal line, and retaining the input signal in the retaining capacitance; the drive transistor supplying a driving current to the electrooptic element according to a signal potential retained in the retaining capacitance; and a compensating circuit for compensating for a decrease in the driving current which decrease is attendant on a secular change of the drive transistor; and in order to detect a decrease in the driving current from a side of the output node, and feed back a result of detection to a side of the input node; the compensating circuit, including detecting means for accumulating charge carried by the driving current for a certain period of time and outputting a detection potential corresponding to an amount of charge accumulated, and feedback means for obtaining a difference by comparing a level of the input signal with a level of the detection potential and adding a potential corresponding to the difference to the signal potential retained in the retaining capacitance.

Specifically, the compensating circuit includes: a switching transistor inserted between the output node and the electrooptic element; another switching transistor connected to the output node; a detecting capacitance connected between the switching transistor connected to the output node and a predetermined ground potential; a feedback capacitance connected between the output node and a predetermined intermediate node; a switching transistor inserted between the intermediate node and the signal line; a switching transistor inserted between a terminal node connected to one terminal of the retaining capacitance and the predetermined ground potential; a switching transistor inserted between the terminal node and the output node; and a switching transistor inserted between the terminal node and the intermediate node.

The present invention also incorporates a display device including scanning lines in a form of rows, signal lines in a form of columns, and pixel circuits arranged in a form of a matrix at parts where the scanning lines intersect the signal lines. In the display device, each pixel circuit includes at least an electrooptic element, a drive transistor, a sampling transistor, and a retaining capacitance; the drive transistor has a gate connected to an input node, a source connected to an output node, and a drain connected to a predetermined power supply potential; the electrooptic element has one terminal connected to the output node and another terminal connected to a predetermined potential; the sampling transistor is connected between the input node and the signal line; the retaining capacitance is connected to the input node; the sampling transistor operates when selected by the scanning line, samples an input signal from the signal line, and retains the input signal in the retaining capacitance; the drive transistor supplies a driving current to the electrooptic element according to a signal potential retained in the retaining capacitance whereby display is made; the pixel circuit further includes a compensating circuit for compensating for a decrease in the driving current which decrease is attendant on a secular change of the drive transistor; and in order to detect a decrease in the driving current from a side of the output node, and feed back a result of detection to a side of the input node, the compensating circuit includes detecting means for accumulating charge carried by the driving current for a certain period of time and outputting a detection potential corresponding to an amount of charge accumulated, and feedback means for obtaining a difference by comparing a level of the input signal with a level of the detection potential and adding a potential corresponding to the difference to the signal potential retained in the retaining capacitance.

Specifically, the compensating circuit includes: a switching transistor inserted between the output node and the electrooptic element; another switching transistor connected to the output node; a detecting capacitance connected between the switching transistor connected to the output node and a predetermined ground potential; a feedback capacitance connected between the output node and a predetermined intermediate node; a switching transistor inserted between the intermediate node and the signal line; a switching transistor inserted between a terminal node connected to one terminal of the retaining capacitance and the predetermined ground potential; a switching transistor inserted between the terminal node and the output node; and a switching transistor inserted between the terminal node and the intermediate node.

According to another embodiment of the present invention, there is provided a driving method of a pixel circuit disposed at a part where a scanning line and a signal line intersect each other, the pixel circuit including at least an electrooptic element, a drive transistor, a sampling transistor, and a retaining capacitance, the drive transistor having a gate connected to an input node, a source connected to an output node, and a drain connected to a predetermined power supply potential, the electrooptic element having one terminal connected to the output node and another terminal connected to a predetermined potential, the sampling transistor being connected between the input node and the signal line, the retaining capacitance being connected to the input node, the driving method including the steps of: the sampling transistor operating when selected by the scanning line, sampling an input signal from the signal line, and retaining the input signal in the retaining capacitance; the drive transistor supplying a driving current to the electrooptic element according to a signal potential retained in the retaining capacitance; in order to compensate for a decrease in the driving current which decrease is attendant on a secular change of the drive transistor by detecting the decrease in the driving current from a side of the output node and feeding back a result of detection to a side of the input node, accumulating charge carried by the driving current for a certain period of time and obtaining a detection potential corresponding to an amount of charge accumulated; and obtaining a difference by comparing a level of the input signal with a level of the detection potential and adding a potential corresponding to the difference to the signal potential retained in the retaining capacitance.

According to another embodiment of the present invention, there is provided a driving method of a display device, the display device including scanning lines in a form of rows, signal lines in a form of columns, and pixel circuits arranged in a form of a matrix at parts where the scanning lines intersect the signal lines, the pixel circuits each including at least an electrooptic element, a drive transistor, a sampling transistor, and a retaining capacitance, the drive transistor having a gate connected to an input node, a source connected to an output node, and a drain connected to a predetermined power supply potential, the electrooptic element having one terminal connected to the output node and another terminal connected to a predetermined potential, the sampling transistor being connected between the input node and the signal line, the retaining capacitance being connected to the input node, the driving method including the steps of: when the sampling transistor operates when selected by the scanning line, samples an input signal from the signal line, and retains the input signal in the retaining capacitance, and the drive transistor supplies a driving current to the electrooptic element according to a signal potential retained in the retaining capacitance, whereby display is made, in order to compensate for a decrease in the driving current which decrease is attendant on a secular change of the drive transistor by detecting the decrease in the driving current from a side of the output node and feeding back a result of detection to a side of the input node, accumulating charge carried by the driving current for a certain period of time and obtaining a detection potential corresponding to an amount of charge accumulated; and obtaining a difference by comparing a level of the input signal with a level of the detection potential and adding a potential corresponding to the difference to the signal potential retained in the retaining capacitance.

According to another embodiment of the present invention, there is provided a pixel circuit disposed at a part where a scanning line and a signal line intersect each other, the pixel circuit including at least: an electrooptic element; a drive transistor; a sampling transistor; a retaining capacitance; the drive transistor having a gate connected to an input node, a source connected to an output node, and a drain connected to a predetermined power supply potential; the electrooptic element having one terminal connected to the output node and another terminal connected to a predetermined potential; the sampling transistor being connected between the input node and the signal line; the retaining capacitance being connected to the input node; the sampling transistor operating when selected by the scanning line, sampling an input signal from the signal line, and retaining the input signal in the retaining capacitance; the drive transistor supplying a driving current to the electrooptic element according to a signal potential retained in the retaining capacitance; and a compensating circuit for compensating for a decrease in the driving current which decrease is attendant on a secular change of the drive transistor. In order to detect a decrease in the driving current from a side of the output node, and feed back a result of detection to a side of the input node, the compensating circuit includes detecting means including a resistive component inserted between the output node and a predetermined ground potential and a capacitive component for retaining, as a detection potential, a voltage drop occurring in the resistive component according to the driving current flowing from the output node to the ground potential, and feedback means for obtaining a difference by comparing a level of the input signal with a level of the detection potential, and adding a potential corresponding to the difference to the signal potential retained in the retaining capacitance.

Specifically, the compensating circuit includes: a switching transistor inserted between the output node and the electrooptic element; another switching transistor connected to the output node; a detecting transistor diode-connected between the switching transistor connected to the output node and the predetermined ground potential; a detecting capacitance connected in parallel with the detecting transistor; a feedback capacitance connected between the output node and a predetermined intermediate node; a switching transistor inserted between the intermediate node and the signal line; a switching transistor inserted between a terminal node connected to one terminal of the retaining capacitance and the predetermined ground potential; a switching transistor inserted between the terminal node and the output node; and a switching transistor inserted between the terminal node and the intermediate node.

The present, invention also incorporates a display device including scanning lines in a form of rows, signal lines in a form of columns, and pixel circuits arranged in a form of a matrix at parts where the scanning lines intersect the signal lines. In the display device, each pixel circuit includes at least an electrooptic element, a drive transistor, a sampling transistor, and a retaining capacitance; the drive transistor has a gate connected to an input node, a source connected to an output node, and a drain connected to a predetermined power supply potential; the electrooptic element has one terminal connected to the output node and another terminal connected to a predetermined potential; the sampling transistor is connected between the input node and the signal line; the retaining capacitance is connected to the input node; the sampling transistor operates when selected by the scanning line, samples an input signal from the signal line, and retains the input signal in the retaining capacitance; the drive transistor supplies a driving current to the electrooptic element according to a signal potential retained in the retaining capacitance, whereby display is made; the pixel circuit further includes a compensating circuit for compensating for a decrease in the driving current which decrease is attendant on a secular change of the drive transistor. In order to detect a decrease in the driving current from a side of the output node, and feed back a result of detection to a side of the input node, the compensating circuit includes detecting means including a resistive component inserted between the output node and a predetermined ground potential and a capacitive component for retaining, as a detection potential, a voltage drop occurring in the resistive component according to the driving current flowing from the output node to the ground potential, and feedback means for obtaining a difference by comparing a level of the input signal with a level of the detection potential, and adding a potential corresponding to the difference to the signal potential retained in the retaining capacitance.

Specifically, the compensating circuit includes: a switching transistor inserted between the output node and the electrooptic element; another switching transistor connected to the output node; a detecting transistor diode-connected between the switching transistor connected to the output node and the predetermined ground potential; a detecting capacitance connected in parallel with the detecting transistor; a feedback capacitance connected between the output node and a predetermined intermediate node; a switching transistor inserted between the intermediate node and the signal line; a switching transistor inserted between a terminal node connected to one terminal of the retaining capacitance and the predetermined ground potential; a switching transistor inserted between the terminal node and the output node; and a switching transistor inserted between the terminal node and the intermediate node.

According to another embodiment of the present invention, there is provided a driving method of a pixel circuit disposed at a part where a scanning line and a signal line intersect each other, the pixel circuit including at least an electrooptic element, a drive transistor, a sampling transistor, and a retaining capacitance, the drive transistor having a gate connected to an input node, a source connected to an output node, and a drain connected to a predetermined power supply potential, the electrooptic element having one terminal connected to the output node and another terminal connected to a predetermined potential, the sampling transistor being connected between the input node and the signal line, the retaining capacitance being connected to the input node, the driving method including the steps of: the sampling transistor operating when selected by the scanning line, sampling an input signal from the signal line, and retaining the input signal in the retaining capacitance; and the drive transistor supplying a driving current to the electrooptic element according to a signal potential retained in the retaining capacitance. In order to compensate for a decrease in the driving current which decrease is attendant on a secular change of the drive transistor by detecting the decrease in the driving current from a side of the output node and feeding back a result of detection to a side of the input node, a voltage drop that occurs in a resistive component inserted between the output node and a predetermined ground potential according to the driving current flowing through the resistive component is obtained, and the voltage drop is set as a detection potential, and a difference is obtained by comparing a level of the input signal with a level of the detection potential, and a potential, corresponding to the difference, is added to the signal potential retained in the retaining capacitance.

According to another embodiment of the present invention, there is provided a driving method of a display device, the display device including scanning lines in a form of rows, signal lines in a form of columns, and pixel circuits arranged in a form of a matrix at parts where the scanning lines intersect the signal lines, the pixel circuits each including at least an electrooptic element, a drive transistor, a sampling transistor, and a retaining capacitance, the drive transistor having a gate connected to an input node, a source connected to an output node, and a drain connected to a predetermined power supply potential, the electrooptic element having one terminal connected to the output node and another terminal connected to a predetermined potential, the sampling transistor being connected between the input node and the signal line, the retaining capacitance being connected to the input node, the driving method including the steps of: when the sampling transistor operates when selected by the scanning line, samples an input signal from the signal line, and retains the input signal in the retaining capacitance, and the drive transistor supplies a driving current to the electrooptic element according to a signal potential retained in the retaining capacitance, whereby display is made, in order to compensate for a decrease in the driving current which decrease is attendant on a secular change of the drive transistor by detecting the decrease in the driving current from a side of the output node and feeding back a result of detection to a side of the input node, obtaining a voltage drop that occurs in a resistive component inserted between the output node and a predetermined ground potential according to the driving current flowing through the resistive component, and setting the voltage drop as a detection potential; and obtaining a difference by comparing a level of the input signal with a level of the detection potential, and adding a potential corresponding to the difference to the signal potential retained in the retaining capacitance.

According to another embodiment of the present invention, there is provided a pixel circuit disposed at a part where a scanning line and a signal line intersect each other, the pixel circuit including at least: a light emitting element; a drive transistor; a sampling transistor; a retaining capacitance; the drive transistor having a gate connected to an input node, a source connected to an output node, and a drain connected to a predetermined power supply potential; the light emitting element having one terminal connected to the output node and another terminal connected to a predetermined potential; the sampling transistor being connected between the input node and the signal line; the retaining capacitance being connected to the input node; the sampling transistor operating when selected by the scanning line, sampling an input signal from the signal line, and retaining the input signal in the retaining capacitance; the drive transistor supplying a driving current to the light emitting element according to a signal potential retained in the retaining capacitance; the light emitting element emitting light with a voltage drop occurring according to the driving current; and a compensating circuit for compensating for a decrease in brightness due to a secular change of the light emitting element; the compensating circuit detecting the voltage drop increasing according to the secular change of the light emitting element from a side of the output node, and feeding back a signal potential corresponding to a level of the detected voltage drop to a side of the input node; the drive transistor supplying a sufficient driving current to compensate for the decrease in brightness of the light emitting element according to the fed-back signal potential.

Specifically, the compensating circuit includes two detecting capacitances connected in series with each other between the output node and the input node; the two detecting capacitances connected in series with each other detect the voltage drop occurring in the light emitting element from the side of the output node and each retain the voltage drop according to a capacitance dividing ratio, and a level of an amount of the voltage drop, which amount is retained by the detecting capacitance situated on the side of the input node, is fed back as the signal potential. More specifically, the compensating circuit includes: a switching transistor inserted in parallel with one detecting capacitance of the two detecting capacitances connected in series with each other, the one detecting capacitance being situated on the side of the output node; a switching transistor inserted between the other detecting capacitance situated on the side of the input node and a predetermined ground potential; a switching transistor inserted between the other detecting capacitance situated on the side of the input node and the input node; a switching transistor inserted between the retaining capacitance and the predetermined ground potential; and a switching transistor inserted between the retaining capacitance and the output node.

According to another embodiment of the present invention, there is provided an image display device including: scanning lines in a form of rows; signal lines in a form of columns; and pixel circuits arranged in a form of a matrix at parts where the scanning lines intersect the signal lines; the pixel circuits each including at least a light emitting element, a drive transistor, a sampling transistor, and a retaining capacitance; the drive transistor having a gate connected to an input node, a source connected to an output node, and a drain connected to a predetermined power supply potential; the light emitting element having one terminal connected to the output node and another terminal connected to a predetermined potential; the sampling transistor being connected between the input node and the signal line; the retaining capacitance being connected to the input node; the sampling transistor operating when selected by the scanning line, sampling an input signal from the signal line, and retaining the input signal in the retaining capacitance; the drive transistor supplying a driving current to the light emitting element according to a signal potential retained in the retaining capacitance; the light emitting element emitting light with a voltage drop occurring according to the driving current; the pixel circuit further incorporating a compensating circuit for compensating for a decrease in brightness due to a secular change of the light emitting element; the compensating circuit detecting the voltage drop increasing according to the secular change of the light emitting element from a side of the output node, and feeding back a signal potential corresponding to a level of the detected voltage drop to a side of the input node; the drive transistor supplying a sufficient driving current to compensate for the decrease in brightness of the light emitting element according to the fed-back signal potential.

Specifically, the compensating circuit includes two detecting capacitances connected in series with each other between the output node and the input node; the two detecting capacitances, connected in series with each other, detect the voltage drop occurring in the light emitting element from the side of the output node and each retain the voltage drop according to a capacitance dividing ratio, and a level of an amount of the voltage drop, which amount is retained by the detecting capacitance situated on the side of the input node, is fed back as the signal potential. More specifically, the compensating circuit includes: a switching transistor inserted in parallel with one detecting capacitance of the two detecting capacitances connected in series with each other, the one detecting capacitance being situated on the side of the output node; a switching transistor inserted between the other detecting capacitance situated on the side of the input node and a predetermined ground potential; a switching transistor inserted between the other detecting capacitance situated on the side of the input node and the input node; a switching transistor inserted between the retaining capacitance and the predetermined ground potential; and a switching transistor inserted between the retaining capacitance and the output node.

According to another embodiment of the present invention, there is provided a driving method of a pixel circuit disposed at a part where a scanning line and a signal line intersect each other, the pixel circuit including at least a light emitting element, a drive transistor, a sampling transistor, and a retaining capacitance, the drive transistor having a gate connected to an input node, a source connected to an output node, and a drain connected to a predetermined power supply potential, the light emitting element having one terminal connected to the output node and another terminal connected to a predetermined potential, the sampling transistor being connected between the input node and the signal line, the retaining capacitance being connected to the input node, the driving method including the steps of: the sampling transistor operating when selected by the scanning line, sampling an input signal from the signal line, and retaining the input signal in the retaining capacitance; the drive transistor supplying a driving current to the light emitting element according to a signal potential retained in the retaining capacitance; the light emitting element emitting light with a voltage drop occurring according to the driving current; in order to compensate for a decrease in brightness due to a secular change of the light emitting element, detecting the voltage drop increasing according to the secular change of the light emitting element from a side of the output node, and feeding back a signal potential corresponding to a level of the detected voltage drop to a side of the input node; and the drive transistor supplying a sufficient driving current to compensate for the decrease in brightness of the light emitting element according to the fed-back signal potential.

According to a further embodiment of the present invention, there is provided a driving method of a display device, the display device including scanning lines in a form of rows, signal lines in a form of columns, and pixel circuits arranged in a form of a matrix at parts where the scanning lines intersect the signal lines, the pixel circuits each including at least a light emitting element, a drive transistor, a sampling transistor, and a retaining capacitance, the drive transistor having a gate connected to an input node, a source connected to an output node, and a drain connected to a predetermined power supply potential, the light emitting element having one terminal connected to the output node and another terminal connected to a predetermined potential, the sampling transistor being connected between the input node and the signal line, the retaining capacitance being connected to the input node, the driving method including the steps of: when the sampling transistor operates when selected by the scanning line, samples an input signal from the signal line, and retains the input signal in the retaining capacitance, the drive transistor supplies a driving current to the light emitting element according to a signal potential retained in the retaining capacitance, and the light emitting element emits light with a voltage drop occurring according to the driving current, whereby display is made, in order to compensate for a decrease in brightness due to a secular change of the light emitting element, detecting the voltage drop increasing according to the secular change of the light emitting element from a side of the output node, and feeding back a signal potential corresponding to a level of the detected voltage drop to a side of the input node; and the drive transistor supplying a sufficient driving current to compensate for the decrease in brightness of the light emitting element according to the fed-back signal potential.

A pixel circuit according to an embodiment of the present invention incorporates a compensating circuit to compensate for a decrease in driving current with a secular change of a drive transistor. This compensating circuit detects a decrease in the driving current from a side of an output node and feeds back a result of detection to a side of an input node, whereby the decrease in the driving current is cancelled by circuit means. Therefore, even when the mobility of the drive transistor is decreased and thereby the driving capability of the drive transistor is decreased, feedback, to the side of the input node, is performed so as to compensate for the decrease. Consequently, the driving current can be maintained at the same constant level as an initial level for a long period of time. It is thereby possible to prevent degradation in brightness which degradation is caused by the drive transistor, and thus maintain screen uniformity over a long period of time.

A pixel circuit according to another embodiment of the present invention incorporates a compensating circuit to compensate for a decrease in brightness due to a secular change of a light emitting element by circuit means in a pixel unit. In addition, it is possible to compensate for initial variations in brightness of light emitting elements which variations appear in pixels. This compensating circuit uses as a principle the fact that a voltage drop occurring in a light emitting element increases according to a secular change of the light emitting element. That is, when brightness is gradually decreased, due to degradation of the light emitting element with the passage of time, the voltage drop tends to be conversely increased according to the decrease. This increasing voltage drop is detected from the side of an output node, and a signal potential corresponding to the detected voltage drop is fed back to the side of an input node. The drive transistor always supplies a driving current from the output node in a direction to compensate for decrease in brightness of the light emitting element according to the fed-back signal potential. It is thereby possible to prevent degradation in brightness of the light emitting element, and thus maintain screen uniformity over a long period of time. In addition, it is possible to compensate for initial variations in brightness of light emitting elements which variations appear in pixels, and thereby improve screen uniformity.

DETAILED DESCRIPTION OF PREFERRED EMBODIMENTS

Figure 1:
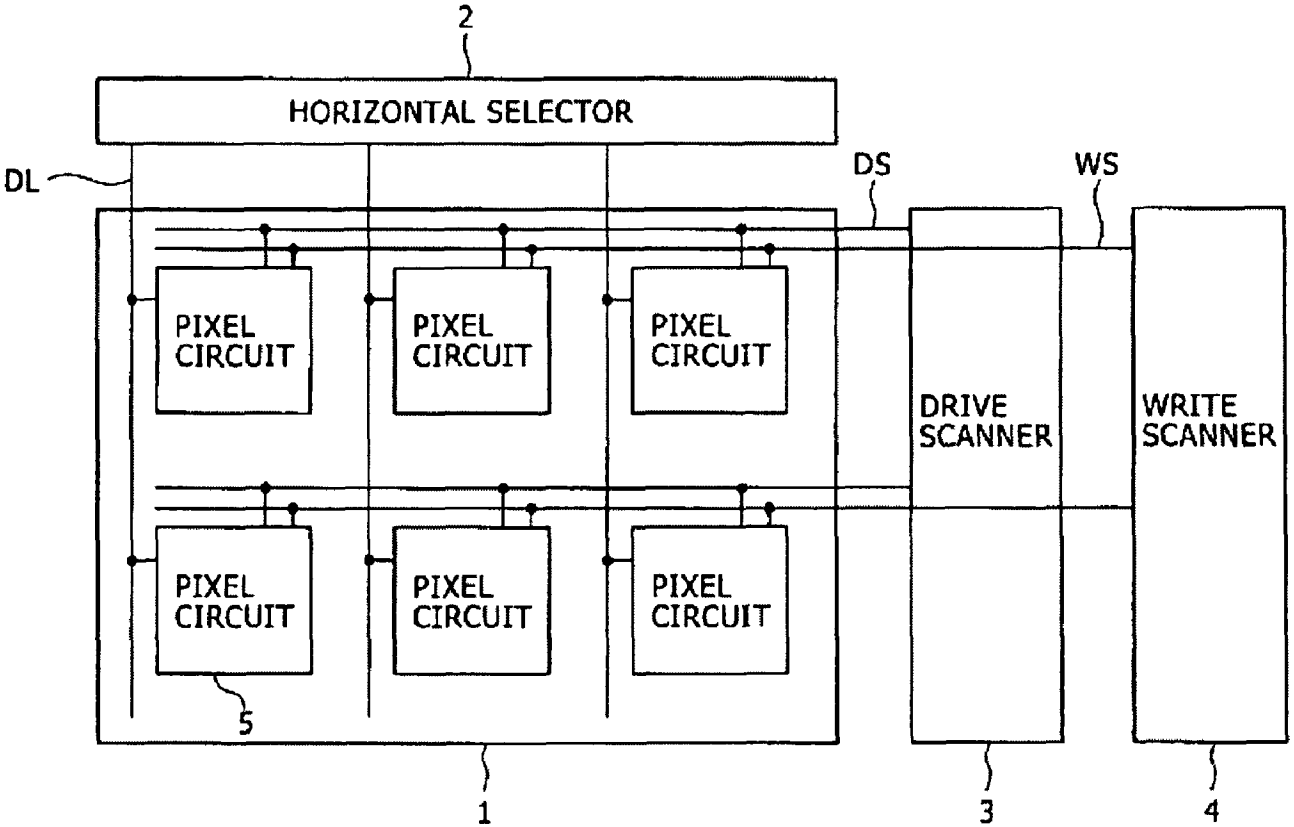
FIG. 1 is a block diagram showing a common configuration of an active matrix display device and a pixel circuit.

Preferred embodiments of the present invention will hereinafter be described in detail with reference to the drawings. In order to explain the background of the present invention, a common configuration of an active matrix display device and a pixel circuit, included in the active matrix display device, will first be described as a reference example with reference to FIG. 1. As shown in the figure, the active matrix display device includes a pixel array 1 as a main part and a peripheral circuit group. The peripheral circuit group includes a horizontal selector 2, a drive scanner 3, a write scanner 4 and the like.

The pixel array 1 includes scanning lines WS in the form of rows, signal lines DL in the form of columns, and pixel circuits 5 arranged in the form of a matrix at parts where the scanning lines WS intersect the signal lines DL. The signal lines DL are driven by the horizontal selector 2. The scanning lines WS are scanned by the write scanner 4. Incidentally, other scanning lines DS are arranged in parallel with the scanning lines WS, and the scanning lines DS are scanned by the drive scanner 3. Each pixel circuit 5 samples a signal from the signal line DL when selected by the scanning line WS. Further, when selected by the scanning line DS, each pixel circuit 5 drives a load element according to the sampled signal. This load element is a light emitting element of a current-driven type or the like formed in each pixel circuit 5.

Figure 2:
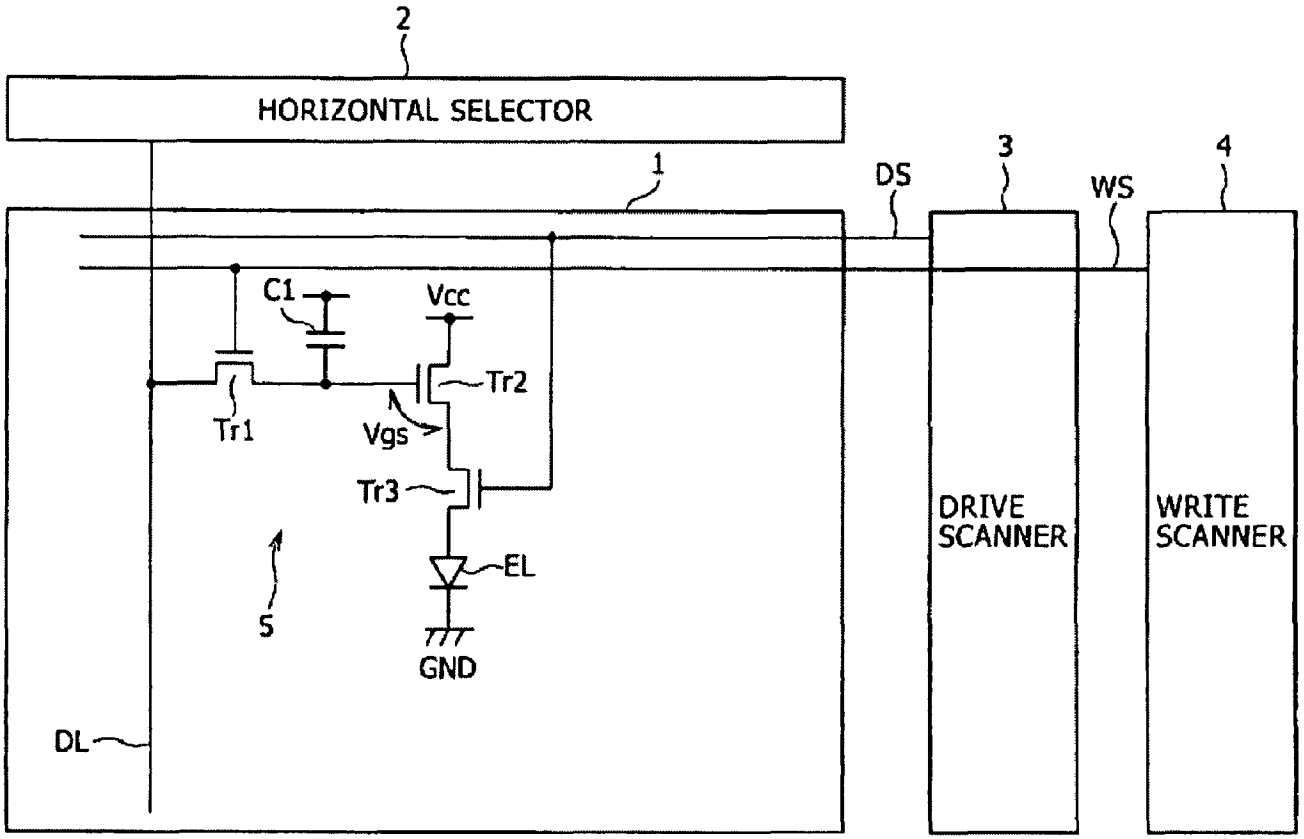
FIG. 2 is a circuit diagram showing a reference example of the pixel circuit.

FIG. 2 is a reference diagram showing a fundamental configuration of a pixel circuit 5 shown in FIG. 1. The pixel circuit 5 includes, for example, a thin-film transistor for sampling (sampling transistor Tr1), a thin-film transistor for drive (drive transistor Tr2), a thin-film transistor for switching (switching transistor Tr3), a retaining capacitance C1, and a load element (organic EL light emitting element).

The sampling transistor Tr1 conducts when selected by a scanning line WS and samples a video signal from a signal line DL to retain the video signal in the retaining capacitance C1. The drive transistor Tr2 controls an amount of current applied to the light emitting element EL according to a signal potential retained in the retaining capacitance C1. The switching transistor Tr3 is controlled by a scanning line DS, and turns on/off the application of the current to the light emitting element EL. That is, the drive transistor Tr2 controls the light emission luminance (brightness) of the light emitting element EL according to the amount of the applied current, whereas the switching transistor Tr3 controls the light emission time of the light emitting element EL. Under these controls, the light emitting element EL included in each pixel circuit 5 exhibits a brightness according to the video signal so that the pixel array 1 shows a desired display.

Figure 3:
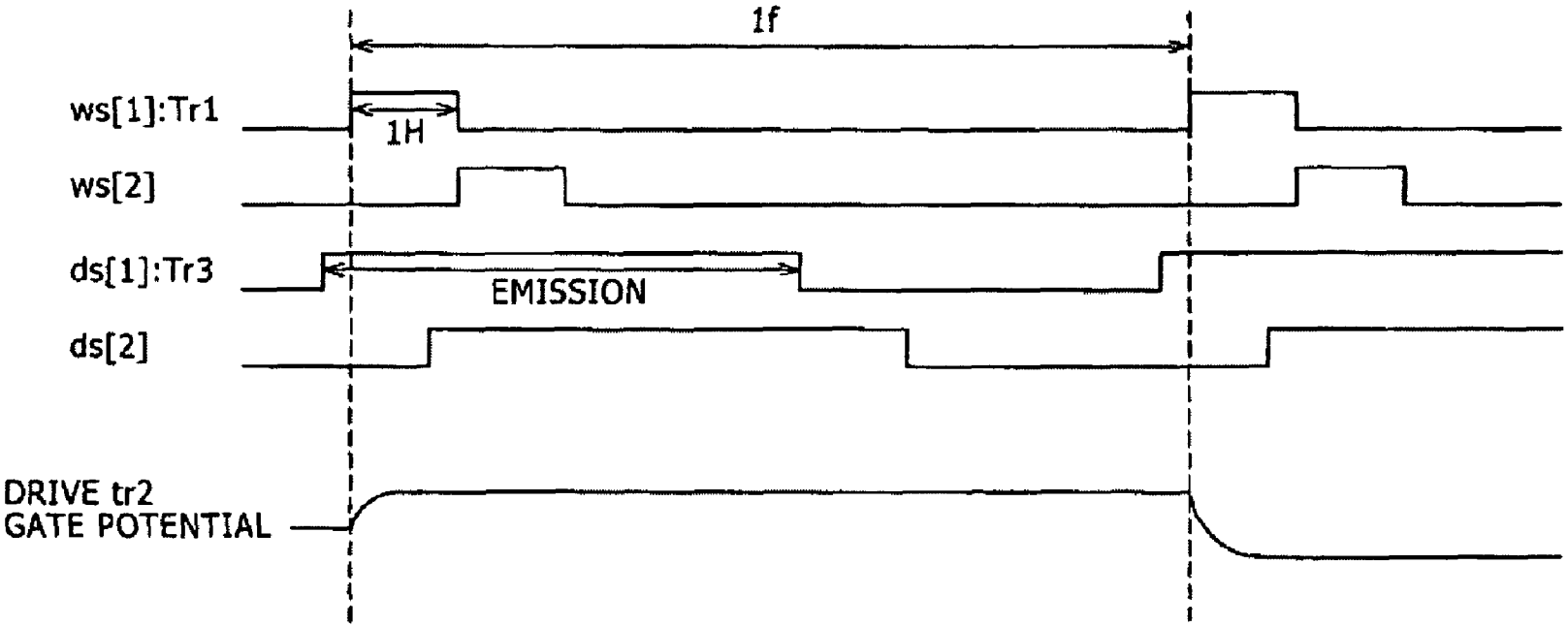
FIG. 3 is a timing chart of assistance in explaining the operation of the pixel circuit shown in FIG. 2.

FIG. 3 is a timing chart of assistance in explaining the operation of the pixel array 1 and the pixel circuit 5 shown in FIG. 2. During one horizontal period (1H) at a start of one field period (1*f*), a selection pulse ws [1] is applied via the scanning line WS to the pixel circuit 5 in a first row so that the sampling transistor Tr1 conducts. Thereby a video signal is sampled from the signal line DL, and written to the retaining capacitance C1. One terminal of the retaining capacitance C1 is connected to the gate of the drive transistor Tr2. Hence, when the video signal is written to the retaining capacitance C1, the gate potential of the drive transistor Tr2 increases according to the written signal potential. At this time, a selection pulse ds [1] is applied to the switching transistor Tr3 via the other scanning line DS. The light emitting element EL continues emitting light while the selection pulse ds [1] is applied. In the latter half of the field period 1*f*, the selection pulse ds [1] is at a low level; therefore, the light emitting element EL is in a non-emitting state. By adjusting the duty factor of the selection pulse ds [1], it is possible to adjust a ratio between a light emission period and a non-emission period, and thus obtain a desired screen brightness. On transition to a next horizontal period, signal pulses ws [2] and ds [2], for scanning, are applied from respective scanning lines WS and DS to pixel circuits in a second row.

Figure 4:
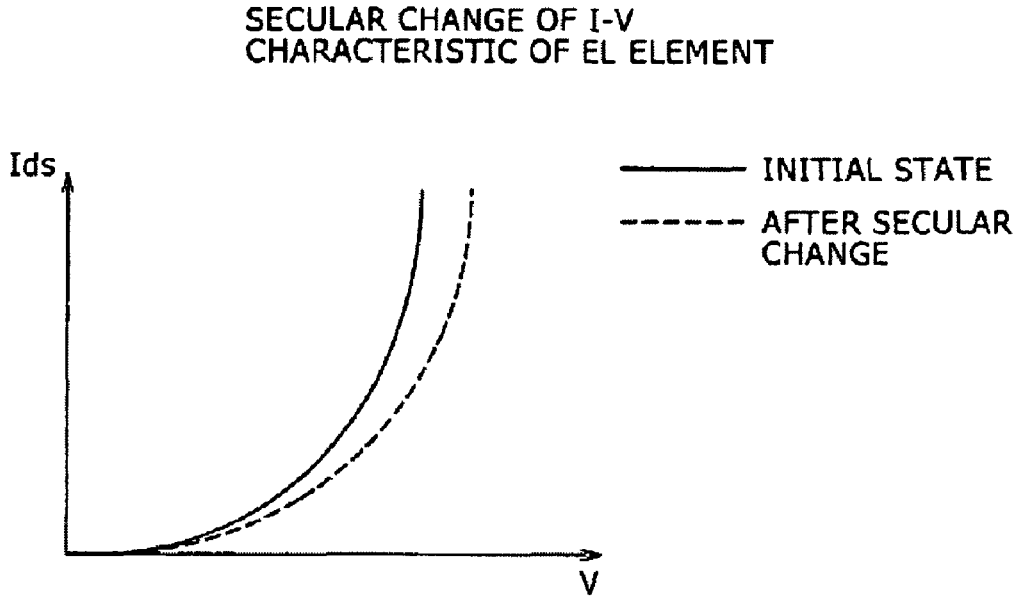
FIG. 4 is a graph showing secular change of an I-V characteristic of an organic EL element.

FIG. 4 is a graph showing secular change of a current-voltage (I-V) characteristic of the organic EL element incorporated as a light emitting element in the pixel circuit 5. In the graph, a curve shown as a solid line represents a characteristic at the time of an initial state, and a curve shown as a broken line represents a characteristic after a secular change. As shown in the graph, the I-V characteristic of the organic EL element is generally degraded with the passage of time. The drive transistor of the pixel circuit in the reference example shown in FIG. 2 is of a source follower configuration. The pixel circuit cannot cope with the secular change of the I-V characteristic of the EL element, so light emission brightness is degraded.

Figure 5A:
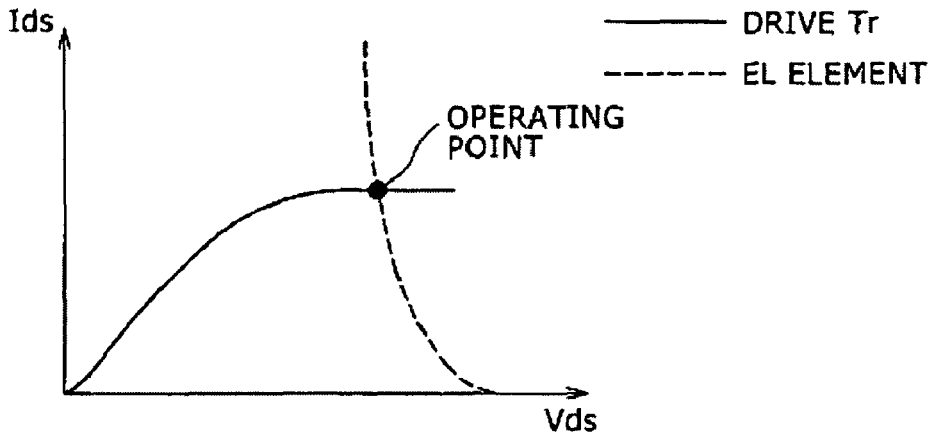
FIGS. 5A and 5B are graphs showing a secular change of an operating point of a drive transistor and an organic EL element.

FIG. 5A is a graph showing an operating point of the drive transistor Tr2 and the light emitting element EL in an initial state. In the figure, the axis of abscissas indicates drain-to-source voltage Vds of the drive transistor Tr2, and the axis of ordinates indicates drain-to-source current Ids of the drive transistor Tr2. As shown in the figure, a source potential is determined by the operating point of the drive transistor Tr2 and the light emitting element EL, and the voltage value has a different value depending on a gate voltage. Since the drive transistor Tr2 operates in a saturation region, the drive transistor Tr2 passes the driving current Ids having a current value defined by the above-described transistor characteristic equation for Vgs corresponding to the source voltage at the operating point.

Figure 5B:
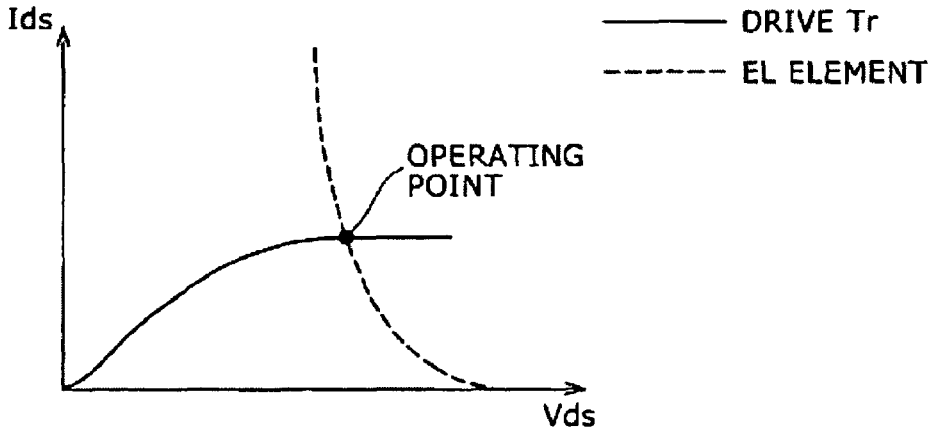
Background Art FIG. 5B

However, the I-V characteristic of the light emitting element EL is degraded with the passage of time as shown in FIG. 4. As shown in FIG. 5B, the operating point is changed because of this degradation with the passage of time, and the source voltage of the transistor is changed even when the same gate voltage is applied. Thereby the gate-to-source voltage Vgs of the drive transistor Tr2 is changed, and the value of the flowing current is varied. At the same time, the value of current flowing through the light emitting element EL is also changed. Thus, the pixel circuit of the source follower configuration in the reference example shown in FIG. 2 has a problem in that when the I-V characteristic of the light emitting element EL is changed, the brightness of the light emitting element EL is changed with the passage of time.

Figure 6:
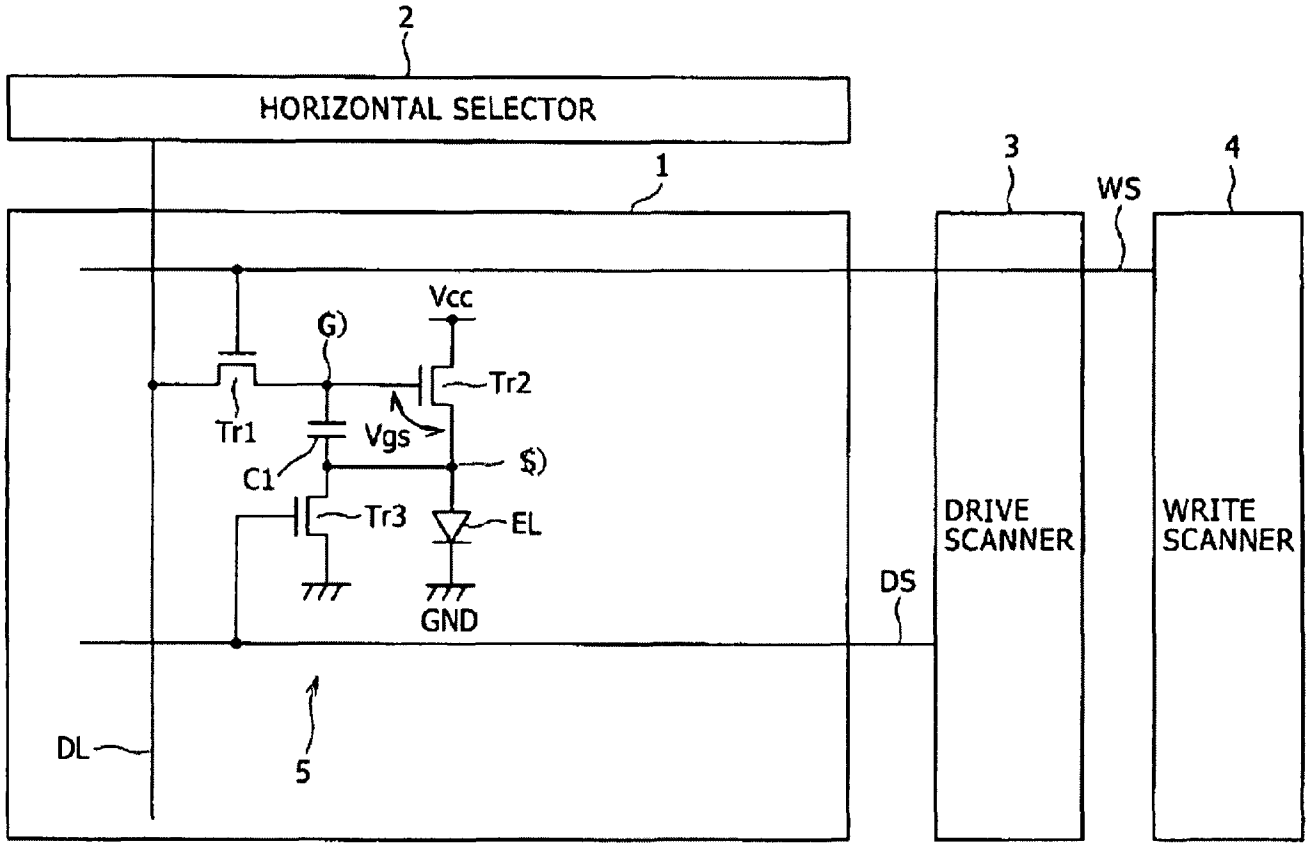
FIG. 6 is a circuit diagram showing another reference example of the pixel circuit.

FIG. 6 shows another reference example of a pixel circuit. This reference example addresses the problem of the foregoing reference example shown in FIG. 2. In order to facilitate understanding, parts corresponding to those of the reference example of FIG. 2 are identified by corresponding reference numerals. An improvement is a change in the connection of the switching transistor Tr3, whereby a bootstrap function is realized. Specifically, the switching transistor Tr3 has a source grounded, a drain connected to the source (S) of a drive transistor Tr2 and one electrode of a retaining capacitance C1, and a gate connected with a scanning line DS. Incidentally, another electrode of the retaining capacitance C1 is connected to the gate (G) of the drive transistor Tr2.

Figure 7:
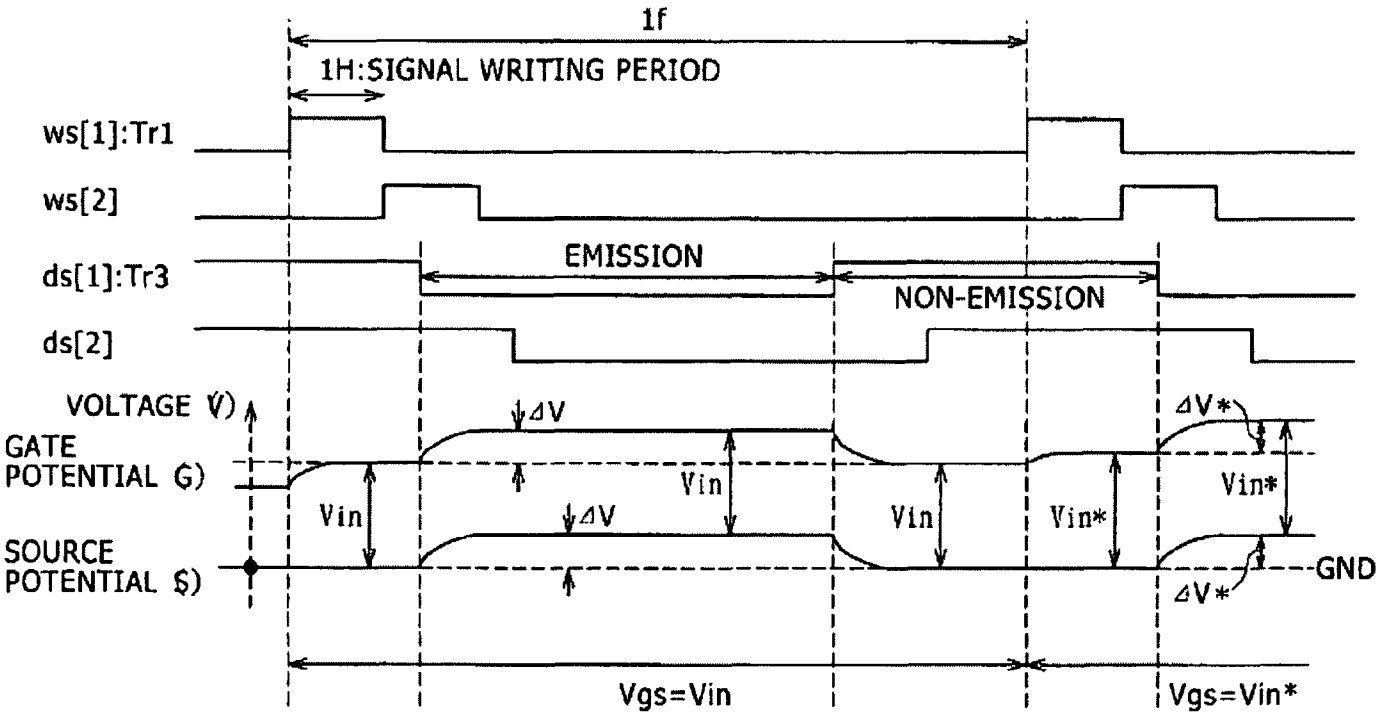
FIG. 7 is a timing chart of assistance in explaining the operation of the pixel circuit shown in FIG. 6.

FIG. 7 is a timing chart of assistance in explaining the operation of the pixel circuit 5 shown in FIG. 6. During a first horizontal period 1H of a field period 1*f*, a selection pulse ws [1] is sent from a write scanner 4 to the pixel circuit 5 in a first row via a scanning line WS. Incidentally, a number in the brackets [ ] corresponds to a row number of pixel circuits arranged in the form of a matrix. When the selection pulse is applied, the sampling transistor Tr1 conducts. Thereby a input signal Vin is sampled from a signal line DL, and written to the retaining capacitance C1. At this time, a selection pulse ds [1] is applied from a drive scanner 3 to the switching transistor Tr3 via the scanning line DS, and thus the switching transistor Tr3 is in an on state. Hence one electrode of the retaining capacitance C1 and the source (S) of the drive transistor Tr2 are at a GND level. Since the input signal Vin is written to the retaining capacitance C1 with this GND level as a reference, the gate potential (G) of the drive transistor Tr2 is Vin.

Thereafter the selection pulse ws [1] for the sampling transistor Tr1 is cleared. Subsequently the selection pulse ds [1] for the switching transistor Tr3 is also cleared. Thereby the sampling transistor Tr1 and the switching transistor Tr3 are turned off. Thus, the source (S) of the drive transistor Tr2 is disconnected from a ground GND, and becomes a node connected to the anode of a light emitting element EL.

The gate of the drive transistor Tr2 receives the input signal Vin retained in the retaining capacitance C1. The drive transistor Tr2 passes a drain current corresponding to the value of the input signal Vin from a Vcc side to a GND side. As a result of the passing of the current, the light emitting element EL emits light. At this time, a voltage drop occurs as a result of the passing of the current through the light emitting element EL, and a source potential (S) correspondingly increases from a GND side to a Vcc side. In the timing chart of FIG. 7, this increase is represented by ⊿V. One terminal of the retaining capacitance C1 is connected to the source (S) of the drive transistor Tr2, and the other terminal of the retaining capacitance C1 is connected to the high-impedance gate (G) of the drive transistor Tr2. Hence, when the source potential (S) increases by ⊿V, the gate potential (G) also rises by the amount of ⊿V so that the net input signal Vin is maintained as it is. Thus, even when the source potential (S) is varied by ⊿V according to the current-voltage characteristic of the light emitting element EL, the gate voltage Vgs=Vin holds at all times; therefore, the drain current is kept constant. That is, even though the drive transistor Tr2 is of a source follower configuration, the drive transistor Tr2 functions as a constant-current source for the light emitting element EL by the above-described bootstrap function.

When the selection pulse ds [1] is thereafter returned to a high level, the switching transistor Tr3 conducts to bypass the current to be supplied to the light emitting element EL. Therefore, the light emitting element EL goes into a non-emitting state. When the field period if is thus ended, a next field period arrives in which a selection pulse ws [1] is applied to the sampling transistor Tr1 again to sample an input video signal Vin*. Since levels of the video signals sampled in the previous field period and this field period may differ from each other, a symbol * is added to the input video signal Vin to distinguish the signals from each other. Incidentally, such video signal writing and light emitting operations are performed on a line sequential basis (in row units). Therefore, selection pulses ws [1], ws [2] . . . are sequentially applied to respective rows of pixels. Similarly, selection pulse ds [1], ds [2] . . . are sequentially applied.

As described above, the pixel circuit of FIG. 6 can perform constant-current driving of the light emitting element EL even when the drive transistor Tr2 is of an N-channel type, and thereby prevents degradation in brightness due to secular change of the I-V characteristic of the light emitting element EL. However, not only does secular change due to aging occur in the light emitting element EL but also secular change occurs in operation characteristics of a thin-film transistor having an amorphous silicon thin film as an element region. In the case of an N-channel type thin-film transistor, in particular, mobility p tends to decrease with the passage of time. Thereby driving capability of the drive transistor Tr2 is decreased. Hence, even when the level of the input signal applied to the gate of the drive transistor Tr2 is constant, the drain current supplied to the light emitting element is reduced, and thus degradation in brightness may occur. Accordingly, the present invention improves the pixel circuit shown in FIG. 6 and incorporates a driving current compensating function. Embodiments of a pixel circuit according to the present invention will hereinafter be described in detail. Incidentally, the pixel circuit can be incorporated as a pixel circuit in the display device shown in FIG. 1.

Figure 8:
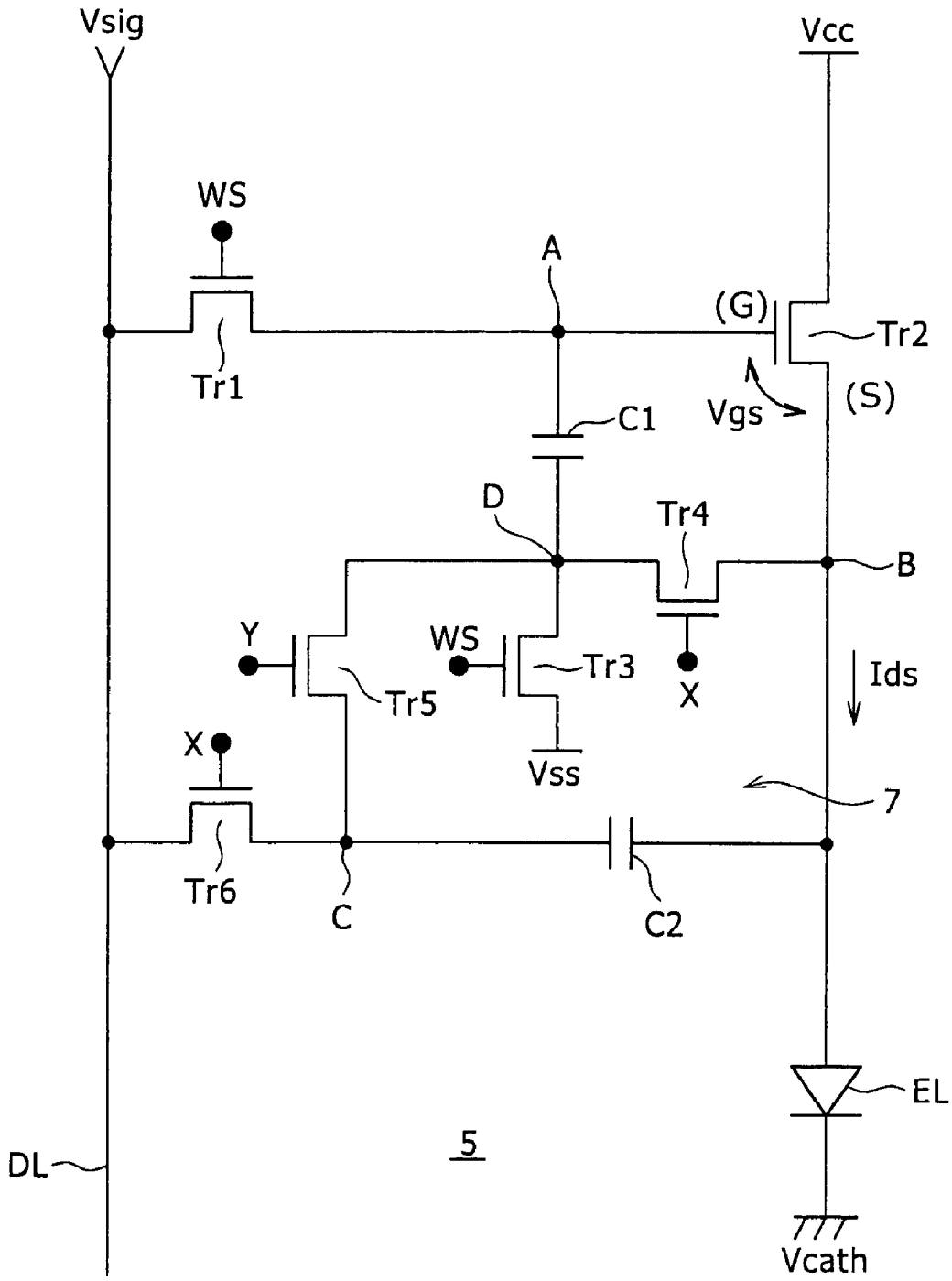
FIG. 8 is a circuit diagram showing an embodiment of a pixel circuit according to the present invention.

FIG. 8 is a schematic circuit diagram showing an embodiment of a pixel circuit according to the present invention. In order to facilitate understanding, corresponding reference numerals are used as much as possible to denote parts corresponding to those of the pixel circuit according to the reference example shown in FIG. 6. As shown in the figure, this pixel circuit 5 is disposed at a part where a scanning line and a signal line intersect each other. A signal line DL is a single line, while three scanning lines WS, X, and Y are bundled together and arranged in parallel with each other. The pixel circuit 5 includes an electrooptic element EL, a drive transistor Tr2, a sampling transistor Tr1, and a retaining capacitance C1 as fundamental components. The drive transistor Tr2 is formed by an N-channel type thin-film transistor. The drive transistor Tr2 has a gate (G) connected to an input node A, a source (S) connected to an output node B, and a drain connected to a predetermined power supply potential Vcc. Incidentally, the gate voltage of the drive transistor Tr2 is denoted by Vgs, and the drain current of the drive transistor Tr2 is denoted by Ids. The electrooptic element EL is formed by a two-terminal light emitting element such as an organic EL element or the like. The electrooptic element EL has an anode as one terminal connected to the output node B, and a cathode as another terminal connected to a predetermined cathode potential Vcath. The sampling transistor Tr1 is connected between the input node A and the signal line DL. The gate of the sampling transistor Tr1 is connected to the scanning line WS. The retaining capacitance C1 is connected to the input node A.

In such a configuration, the sampling transistor Tr1 operates when selected by the scanning line WS, samples an input signal Vsig from the signal line DL, and retains the input signal Vsig in the retaining capacitance C1. The drive transistor Tr2 supplies a driving current (drain current Ids) to the electrooptic element EL according to the signal potential Vin retained in the retaining capacitance C1.

As a feature of the present invention, the pixel circuit 5 has a compensating circuit 7 for compensating for a decrease in the driving current (drain current Ids) which decrease is attendant on a secular change of the drive transistor Tr2. This compensating circuit 7 detects a decrease in the driving current (drain current Ids) from the side of the output node B, and feeds back a result of the detection to the side of the input node A. Thus, even when the drain current Ids is decreased with the passage of time, feedback is performed so as to cancel the decrease. Therefore, in spite of decrease in driving capability of the drive transistor Tr2 with the passage of time, the drain current Ids having the same level as an initial level can be ensured even after the passage of a long period of time.

As for a concrete feedback configuration, the compensating circuit 7 detects a voltage drop occurring in the electrooptic element EL according to the drain current Ids from the side of the output node B, obtains a difference by comparing the level of the input signal Vsig with the level of the detected voltage drop, and adds a potential corresponding to the difference to the signal potential Vin retained in the retaining capacitance C1. To supplement the above description, a voltage drop occurs when a driving current flows through the light emitting element EL. This voltage drop is proportional to the magnitude of the driving current. Hence, a change in the driving current can be detected by monitoring the voltage drop. The detected voltage drop is compared and evaluated with the input signal Vsig as a reference level. By feeding back a result of the comparison and evaluation to the side of the input node A, a decrease in the drain current Ids is cancelled.

As for a concrete configuration, the compensating circuit 7 includes four N-channel type thin-film transistors and one capacitive element added to the pixel circuit of the reference example shown in FIG. 6. Specifically, the compensating circuit 7 includes: a detecting capacitance C2 connected between the output node B and a predetermined intermediate node C; a switching transistor Tr6 inserted between the intermediate node C and the signal line DL; a switching transistor Tr3 inserted between a terminal node D connected to one terminal of the retaining capacitance C1 and a predetermined ground potential Vss; a switching transistor Tr4 inserted between the terminal node D and the output node B; and a switching transistor Tr5 inserted between the terminal node D and the intermediate node C. Of these components, the switching transistors Tr4, Tr5, and Tr6 are added transistor elements as compared with the pixel circuit according to the reference example shown in FIG. 6.

The gate of the switching transistor Tr3 is connected to the scanning line WS. The gate of the switching transistor Tr4 is connected to the scanning line X. The gate of the switching transistor Tr5 is connected to the scanning line Y. The gate of the switching transistor Tr6 is connected to the scanning line X. As is clear from this, the sampling transistor Tr1 and the switching transistor Tr3 are controlled to be turned on/off in the same timing via the common scanning line WS. In addition, the switching transistors Tr4 and Tr6 are controlled to be turned on/off in the same timing via the common scanning line X. The remaining switching transistor Tr5 is controlled to be turned on/off in different timing from that of the other switching transistors via the scanning line Y.

Figure 9:
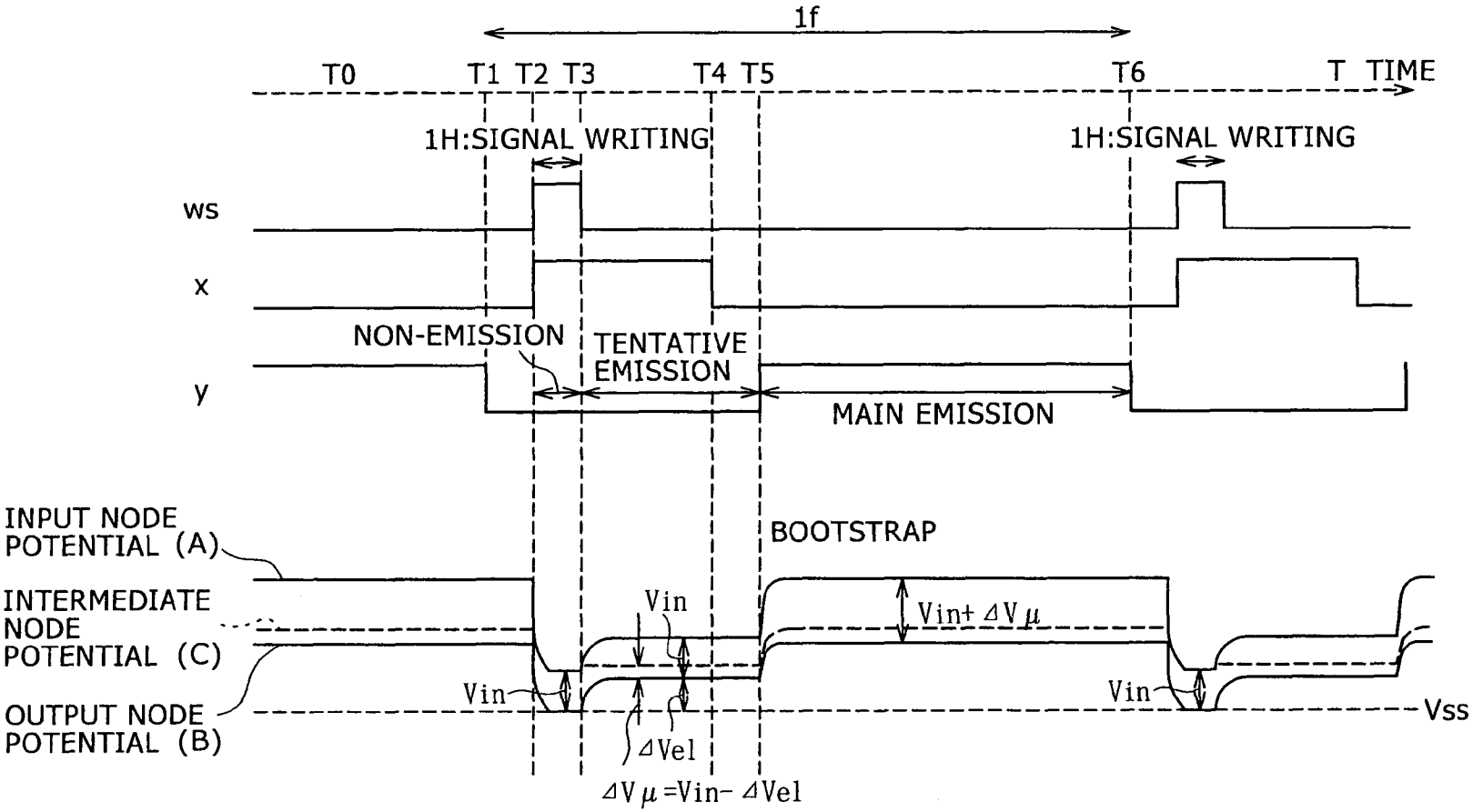
FIG. 9 is a timing chart of assistance in explaining the operation of the embodiment shown in FIG. 8.

The operation of the pixel circuit shown in FIG. 8 will be described in detail with reference to a timing chart of FIG. 9. The timing chart of FIG. 9 shows one field (1*f*) starting in timing T1 and ending in timing T6. The waveforms of a pulse ws applied to the scanning line WS, a pulse x applied to the scanning line X, and a pulse y applied to the scanning line Y are shown along a time axis T. In addition, changes in potentials of the input node A, the intermediate node C, and the output node B are shown along the same time axis T. The change in the potential of the input node A and the change in the potential of the output node B are represented by a solid line, and the change in the potential of the intermediate node C is represented by a dotted line to be distinguished from the change in the potential of the input node A and the change in the potential of the output node B.

In timing T0, before entering the field, the scanning lines WS and X are maintained at a low level while the scanning line Y is at a high level. Therefore, the sampling transistor Tr1 and the switching transistors Tr3, Tr4, and Tr6 are off, and only the switching transistor Tr5 is in an on state. At this time, as shown in the timing chart, there is a potential difference substantially equal to an input potential Vin between the potential of the input node A and the potential of the output node B; therefore, the drive transistor Tr2 is in an on state to supply a driving current (drain current) Ids to the light emitting element EL.

When entering the field, the scanning line Y is changed to a low level in timing T1. Thereby the switching transistor Tr5 is turned off. The switching transistors Tr3 and Tr4 are also in an off state in timing T1. Therefore, the terminal node D of the retaining capacitance C1 has a high impedance. However, since the potential of the input node A continues to be maintained, light emission is continued. The operation in timing T1 corresponds to a preparation for sampling an input signal in the field.

Nest, in timing T2, the input signal Vsig is actually sampled (signal writing). Specifically, a selection pulse ws is applied to the scanning line WS, and a selection pulse x is applied to the scanning line X. As a result, the scanning line WS and the scanning line X are both changed to a high level. Thereby the sampling transistor Tr1 is turned on, and the switching transistor Tr3 is turned on. The switching transistors Tr4 and Tr6 are also turned on. As a result, the terminal node D of the retaining capacitance C1 is pulled down to the ground potential Vss. Also, the output node B is sharply decreased to the ground level Vss. At the same time, a new input signal Vsig is sampled into the retaining capacitance C1 from the signal line DL via the sampling transistor Tr1, changed to an on state. As a result, the signal potential Vin is written to the retaining capacitance C1. In other words, the potential of the input node A becomes Vin with respect to the output node B at the ground potential Vss.

When one horizontal period (1H) assigned to the writing of the input signal has passed, the selection pulse ws is cleared in timing T3 to return the scanning line WS to a low level. Thereby the sampling transistor Tr1 is turned off, and the switching transistor Tr3 is turned off. The terminal node D of the retaining capacitance C1 is, therefore, disconnected from the ground potential Vss. Instead, since the switching transistor Tr4 remains in an on state, the terminal node D of the retaining capacitance C1 is directly connected to the output node B. The signal potential Vin is thereby applied between the gate and the source of the drive transistor Tr2 (between the input node A and the output node B) so that a drain current Ids, corresponding to the signal potential Vin, flows into the light emitting element EL. The light emitting element EL thereby emits light tentatively.

When the drain current Ids flows through the light emitting element EL in timing T3, a voltage drop $\Delta$Vel occurs, and the potential of the output node B increases correspondingly. At this time, bootstrap operation increases the potential of the input node A by $\Delta$Vel in such a manner as to be interlocked with the potential of the output node B.

The drain current Ids, flowing through the light emitting element EL, flows into the detecting capacitance C2 at the same time so that one terminal of the detecting capacitance C2 obtains the potential $\Delta$Vel. Another terminal of the detecting capacitance C2 is connected to the signal line DL via the intermediate node C by the switching transistor Tr6 in an on state. The potential of the other terminal of the detecting capacitance C2 thereby becomes substantially Vin. Hence, the detecting capacitance C2 retains a difference $\Delta V\mu = Vin - \Delta Vel$ between the potentials of the two terminals of the detecting capacitance C2. In the timing chart of FIG. 9, this difference $\Delta V\mu$ appears as a potential difference between the intermediate node C and the output node B. When characteristics of the drive transistor Tr2 are degraded with the passage of time and mobility $\mu$ of the drive transistor Tr2 is decreased, the drain current Ids is correspondingly decreased. As a result, the voltage drop $\Delta$Vel occurring in the light emitting element EL is reduced. Thus, when the potential Vin serves as a reference, the value of the difference $\Delta V\mu$ is increased by an amount by which the voltage drop $\Delta$Vel is reduced. That is, when the drain current Ids is decreased, due to degradation with the passage of time of the drive transistor, the difference $\Delta V\mu$ is conversely increased. By feeding back the difference ⊿Vμ to the side of the input node A, a decrease in the drain current Ids is cancelled so that the drain current Ids can be maintained at the same constant level as an initial level.

In timing T4, after the detection of the decrease in the drain current Ids, the scanning line X is changed from a high level to a low level. The switching transistors Tr4 and Tr6 are thereby turned off. That is, the terminal node D of the retaining capacitance C1 is disconnected from the output node B. Also, the intermediate node C connected to the terminal of the detecting capacitance C2 is disconnected from the signal line DL. A preparation for main emission operation is thereby completed.

Thereafter, in timing T5, the scanning line Y rises from a low level to a high level. The switching transistor Tr5 is thereby turned on to connect the terminal node D directly with the intermediate node C. Hence, the retaining capacitance C1 and the detecting capacitance C2 are connected in series with each other between the input node A and the output node B. The difference ⊿Vμ retained by the detecting capacitance C2 as well as the signal potential Vin, retained by the retaining capacitance C1, is applied between the input node A and the output node B. The drive transistor Tr2 supplies a drain current Ids corresponding to Vin+⊿Vμ to the light emitting element EL, whereby main emission is started. Due to a voltage drop occurring in the light emitting element EL, the potential of the output node B is increased. The potential of the input node A is also increased in such a manner as to be interlocked with the potential of the output node B. This bootstrap operation maintains a potential difference between the input node A and the output node B at the value of Vin+⊿Vμ. As described above, when the drain current Ids is decreased, due to degradation of the drive transistor Tr2, the difference ⊿Vμ is increased so as to compensate for the decrease. This feedback operation suppresses the variation in the drain current Ids so that the drain current Ids, having the same level as an initial level, can be made to flow irrespective of change in the mobility p of the drive transistor Tr2.

Thereafter, in timing T6, the scanning line Y falls to a low level, whereby the main light emission is ended. Thereby a series of operations in the field is completed, and the next field is started.

Figure 10:
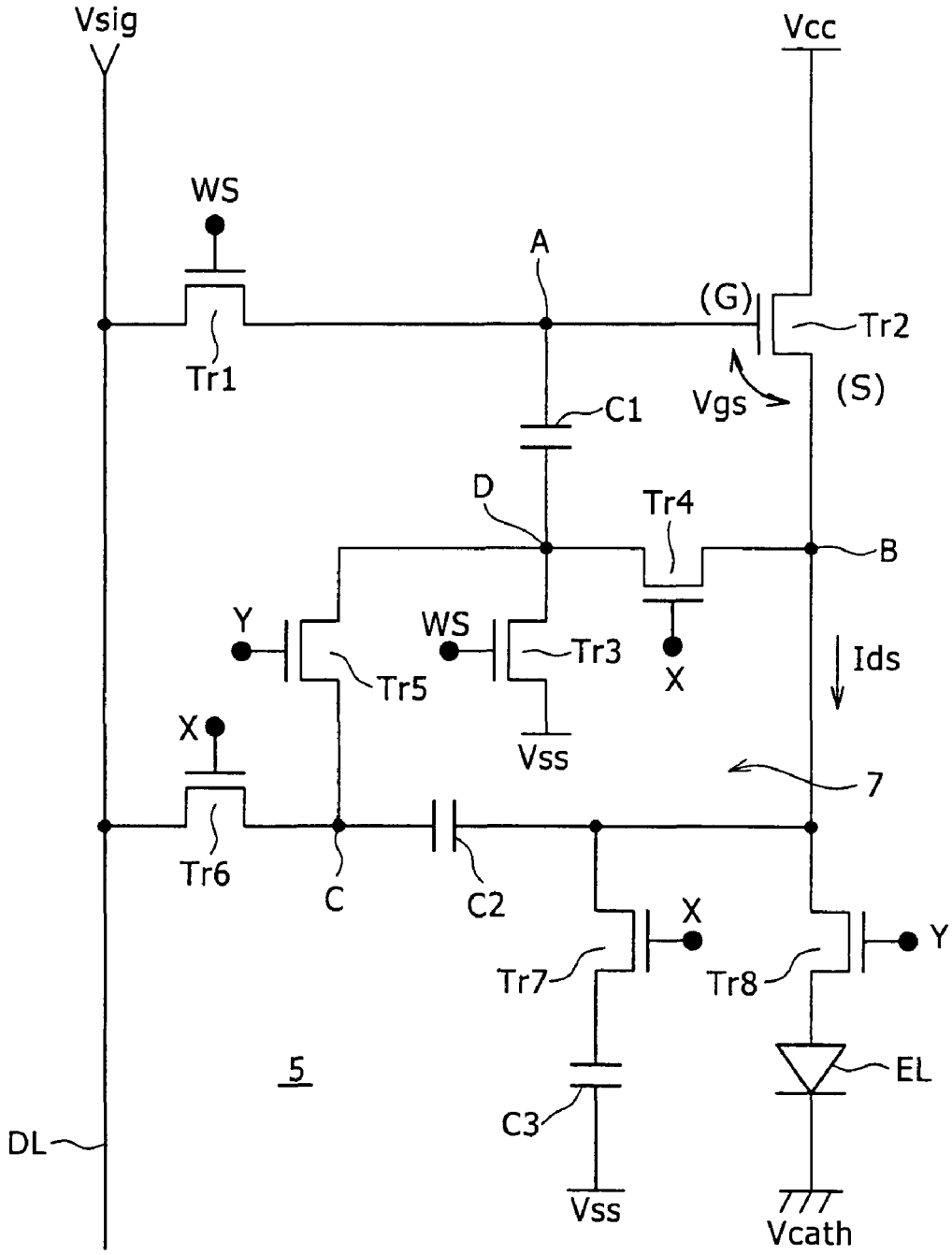
FIG. 10 is a circuit diagram showing another embodiment of a pixel circuit according to the present invention.

FIG. 10 is a schematic circuit diagram showing another embodiment of a pixel circuit according to the present invention. In order to facilitate understanding, corresponding reference numerals are used as much as possible to denote parts corresponding to those of the pixel circuit according to the reference example shown in FIG. 6. As shown in the figure, this pixel circuit 5 is disposed at a part where a scanning line and a signal line intersect each other. A signal line DL is a single line while three scanning lines WS, X, and Y are bundled together and arranged in parallel with each other. The pixel circuit 5 includes an electrooptic element EL, a drive transistor Tr2, a sampling transistor Tr1, and a retaining capacitance C1 as fundamental components. The drive transistor Tr2 is formed by an N-channel type thin-film transistor. The drive transistor Tr2 has a gate (G) connected to an input node A, a source (S) connected to an output node B, and a drain connected to a predetermined power supply potential Vcc. Incidentally, the gate voltage of the drive transistor Tr2 is denoted by Vgs, and the drain current of the drive transistor Tr2 is denoted by Ids. The electrooptic element EL is formed by a two-terminal light emitting element such as an organic EL element or the like. The electrooptic element EL has an anode as one terminal connected to the side of the output node B, and a cathode as another terminal connected to a predetermined cathode potential Vcath. The sampling transistor Tr1 is connected between the input node A and the signal line DL. The gate of the sampling transistor Tr1 is connected to the scanning line WS. The retaining capacitance C1 is connected to the input node A.

In such a configuration, the sampling transistor Tr1 operates when selected by the scanning line WS, samples an input signal Vsig from the signal line DL, and retains the input signal Vsig in the retaining capacitance C1. The drive transistor Tr2 supplies a driving current (drain current Ids) to the electrooptic element EL according to the signal potential Vin retained in the retaining capacitance C1.

As a feature of the present invention, the pixel circuit 5 has a compensating circuit 7 for compensating for a decrease in the driving current (drain current Ids) which decrease is attendant on a secular change of the drive transistor Tr2. This compensating circuit 7 detects a decrease in the drain current Ids of the drive transistor Tr2 from the side of the output node B and feeds back a result of the detection to the side of the input node A. For this purpose, the compensating circuit 7 includes a detecting section, for accumulating charge carried by the drain current Ids for a certain period of time and outputting a detection potential corresponding to an amount of charge accumulated, and a feedback section, for obtaining a difference ⊿Vμ by comparing the level Vin of the input signal Vsig with the level of the detection potential and adding a potential corresponding to the difference to the signal potential Vin retained in the retaining capacitance C1.

Specifically, the compensating circuit 7 includes six transistors Tr3 to Tr8 and two capacitances C2 and C3. The switching transistor Tr8 is inserted between the output node B and the electrooptic element EL. The switching transistor Tr7 is also connected to the output node B. The detecting capacitance C3 is connected between the switching transistor Tr7 and a predetermined ground potential Vss. The switching transistors Tr7 and Tr8 and the detecting capacitance C3 form the above-described detecting section of the compensating circuit 7.

The feedback capacitance C2 is connected between the output node B and a predetermined intermediate node C. The switching transistor Tr6 is inserted between the intermediate node C and the signal line DL. The switching transistor Tr3 is inserted between a terminal node D connected to one terminal of the retaining capacitance C1 and the predetermined ground potential Vss. The switching transistor Tr4 is inserted between the terminal node D and the output node B. The switching transistor Tr5 is inserted between the terminal node D and the intermediate node C. The feedback capacitance C2 and the switching transistors Tr5 and Tr6 form the above-described feedback section of the compensating circuit 7.

The gate of the switching transistor Tr3 is connected to the scanning line WS. The gates of the switching transistors Tr4, Tr6, and Tr7 are connected to another scanning line X. The switching transistors Tr5 and Tr8 are connected to yet another scanning line Y.

Figure 11:
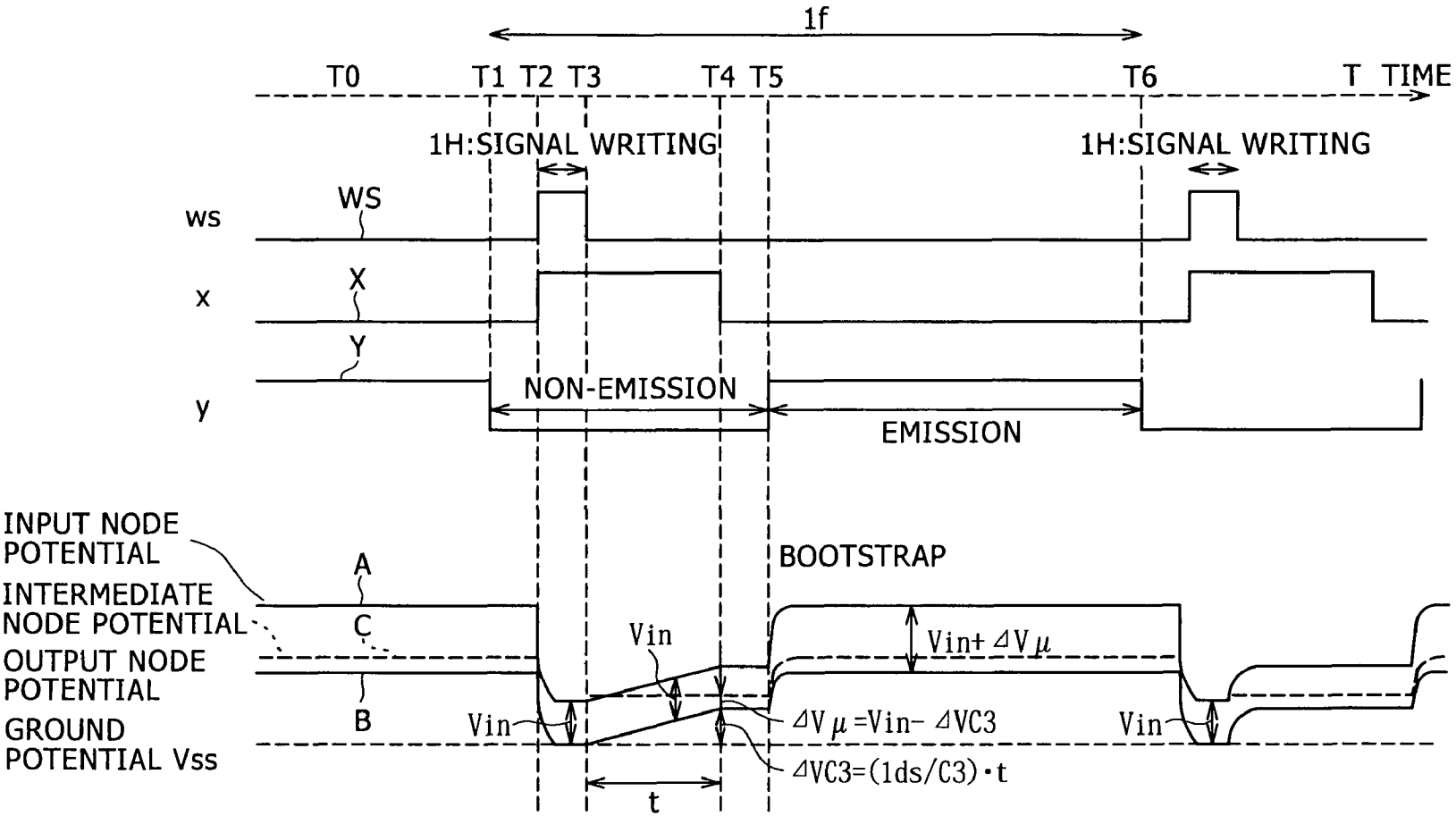
FIG. 11 is a timing chart of assistance in explaining the operation of the other embodiment shown in FIG. 10.

The operation of the pixel circuit shown in FIG. 10 will be described in detail with reference to a timing chart of FIG. 11. The timing chart of FIG. 11 shows one field (1*f*) starting in timing T1 and ending in timing T6. The waveforms of a pulse ws applied to the scanning line WS, a pulse x applied to the scanning line X, and a pulse y applied to the scanning line Y are shown along a time axis T. In addition, changes in potentials of the input node A, the intermediate node C, and the output node B are shown along the same time axis T. The change in the potential of the input node A and the change in the potential of the output node B are represented by a solid line, and the change in the potential of the intermediate node C is represented by a dotted line to be distinguished from the change in the potential of the input node A and the change in the potential of the output node B.

In timing T0, before entering the field, the scanning lines WS and X are maintained at a low level, while the scanning line Y is at a high level. Therefore, the sampling transistor Tr1 and the switching transistors Tr3, Tr4, Tr6, and Tr7 are off, and only the switching transistors Tr5 and Tr8 are in an on state. At this time, as shown in the timing chart, there is a potential difference substantially equal to an input potential Vin between the potential of the input node A and the potential of the output node B; therefore, the drive transistor Tr2 is in an on state to supply a driving current (drain current) Ids to the light emitting element EL.

When entering the field, the scanning line Y is changed to a low level in timing T1. Thereby the switching transistors Tr5 and Tr8 are turned off. Therefore, the light emitting element EL is disconnected from the output node B and thus goes into a non-emitting state. The switching transistors Tr3 and Tr4 are also in an off state in timing T1 in addition to the switching transistor Tr5. Therefore, the terminal node D of the retaining capacitance C1 has a high impedance. The operation in timing T1 corresponds to a preparation for sampling an input signal in the field.

In timing T2, a selection pulse ws is applied to the scanning line WS, and a selection pulse x is applied to the scanning line X. The scanning line WS is thereby changed to a high level to turn on the sampling transistor Tr1 and the switching transistor Tr3. At the same time, the scanning line X is changed from a low level to a high level so that the transistors Tr4, Tr6, and Tr7 are turned on.

Since the switching transistor Tr3 is turned on, the terminal node D is connected to the ground potential Vss. Since the switching transistor Tr4 is turned on, the output node B is directly connected to the terminal node D. As a result, the potential of the output node B is sharply decreased to the ground level Vss. At this time, since the sampling transistor Tr1 is also turned on, an input signal Vsig, supplied to the signal line DL, is written to the retaining capacitance C1. The magnitude of a written signal potential Vin is substantially equal to that of the voltage of the input signal Vsig. Since the terminal node D is fixed at the ground potential Vss, the potential of the input node A is precisely Vin as shown in the timing chart. This input potential Vin is applied between the gate G and the source S of the drive transistor Tr2 so that a drain current Ids, corresponding to the signal potential Vin, flows out from the output node B.

However, since the switching transistor Tr8 is in an off state as described above, the drain current Ids is not supplied to the light emitting element EL. The light emitting element EL, therefore, continues maintaining the non-emitting state.

When one horizontal period (1H), assigned to the operation of writing of the input signal, has passed, the selection pulse ws is cleared in timing T3 to return the scanning line WS from a high level to a low level. Thereby the sampling transistor Tr1 and the switching transistor Tr3 are turned off. As a result, the terminal node D and the output node B are disconnected from the ground potential Vss. In response to this, the potential of the output node B starts to rise, and the drain current Ids starts to flow into the detecting capacitance C3 via the switching transistor Tr7 in an on state. With accumulation of charge, the potential of the output node B continues rising. At this time, since the terminal node D is disconnected from the ground potential Vss, the potential of the input node A rises in such a manner as to be interlocked with the potential of the output node B. A potential difference Vin between the input node A and the output node B is kept constant.

In timing T4, after the passage of a predetermined time t from timing T3, the selection pulse x is cleared to return the scanning line X from a high level to a low level. The transistors Tr4, Tr7 and Tr6 are thereby turned off. In a stage in which the switching transistor Tr7 is turned off, the charge accumulation of the detecting capacitance C3 is completed. The potential of the detecting capacitance C3, which potential corresponds to the accumulated charge, is given by $\Delta VC3=(Ids/C3)\cdot t$. As is clear from this equation, the detection potential $\Delta VC3$ is proportional to the drain current Ids because the capacitance value C3 and the accumulation time t are fixed. That is, the detection potential $\Delta VC3$ has a value proportional to the drain current Ids of the drive transistor Tr2. As the mobility p of the drive transistor Tr2 is decreased with the passage of time, the detection potential $\Delta VC3$ is correspondingly lowered.

The switching transistors Tr6 and Tr7 are in an on state until immediately before the scanning line X falls to a low level in timing T4. The feedback capacitance C2 is, therefore, at the potential Vin of the input signal Vsig on the side of the intermediate node C. The potential of the feedback capacitance C2 on the side of the output node B is precisely $\Delta VC3$. Hence, when the selection pulse x is cleared and the switching transistors Tr6 and Tr7 are thereby turned off, the feedback capacitance C2 holds a potential $\Delta V\mu$ corresponding to a difference between the potential Vin and the detection potential $\Delta VC3$. That is, the potential $\Delta V\mu$ is expressed by $\Delta V\mu=Vin-\Delta VC3$. As described above, when the drain current Ids is decreased, due to degradation of the drive transistor Tr2, the detection potential $\Delta VC3$ is also decreased. Hence, the potential $\Delta V\mu$ is increased. By feeding back the potential $\Delta V\mu$ held by the feedback capacitance C2 to the side of the input node A, it is possible to cancel the decrease in the drain current Ids. This feedback operation makes it possible to continue supplying the drain current Ids having the same level as an initial level even when a degradation occurs in an operation characteristic of the drive transistor Tr2 such as mobility or the like.

The present invention compares and determines the magnitude of the detection potential $\Delta VC3$ with the signal potential Vin of the input signal Vsig as a reference. The signal potential Vin varies in a predetermined range (for example 0 to 5 V). The drain current Ids correspondingly varies, and the detection potential $\Delta VC3$ has a corresponding level. The signal potential Vin and the detection potential $\Delta VC3$ thus change in the same direction so that dynamic comparison is possible. As a precondition, the dynamic range of the signal potential Vin and the dynamic range of the detection potential $\Delta VC3$ need to substantially match each other. Supposing that the dynamic range of the signal potential Vin is 0 to 5 V as described above, it is desirable that the detection potential $\Delta VC3$ vary in substantially a range of 0 to 5 V. In order to set the dynamic range of the detection potential $\Delta VC3$ to the desired range, it is necessary to set the accumulation time t and the capacitance of the detecting capacitance C3 appropriately.

Thereafter, in timing T5, a selection pulse y is applied to change the scanning line Y from a low level to a high level. The switching transistors Tr5 and Tr8 are thereby turned on. By turning on the switching transistor Tr8, the anode of the electrooptic element EL is directly connected to the output node B. By turning on the switching transistor Tr5, the intermediate node C is directly connected to the terminal node D. The potential $\Delta V\mu$, retained by the feedback capacitance C2, as well as the signal potential Vin, retained by the retaining capacitance C1, are applied between the input node A and the output node B. The drive transistor Tr2 supplies a drain current Ids corresponding to Vin+⊿Vμ to the light emitting element EL, whereby light emission is started. Due to a voltage drop occurring in the light emitting element EL, the potential of the output node B is increased. The potential of the input node A is also increased in such a manner as to be interlocked with the potential of the output node B. This bootstrap operation maintains a potential difference between the input node A and the output node B at the value of Vin+⊿Vμ. As described above, when the drain current Ids is decreased, due to degradation of the drive transistor Tr2, the potential ⊿Vμ is increased so as to compensate for the decrease. This feedback operation suppresses the variation in the drain current Ids so that the drain current Ids, having the same level as an initial level, can be made to flow irrespective of change in the mobility μ of the drive transistor Tr2.

Thereafter, in timing T6, the scanning line Y falls to a low level to turn off the switching transistor Tr8 whereby the light emission is ended. Thereby a series of operations in the field is completed, and the next field is started.

Figure 12:
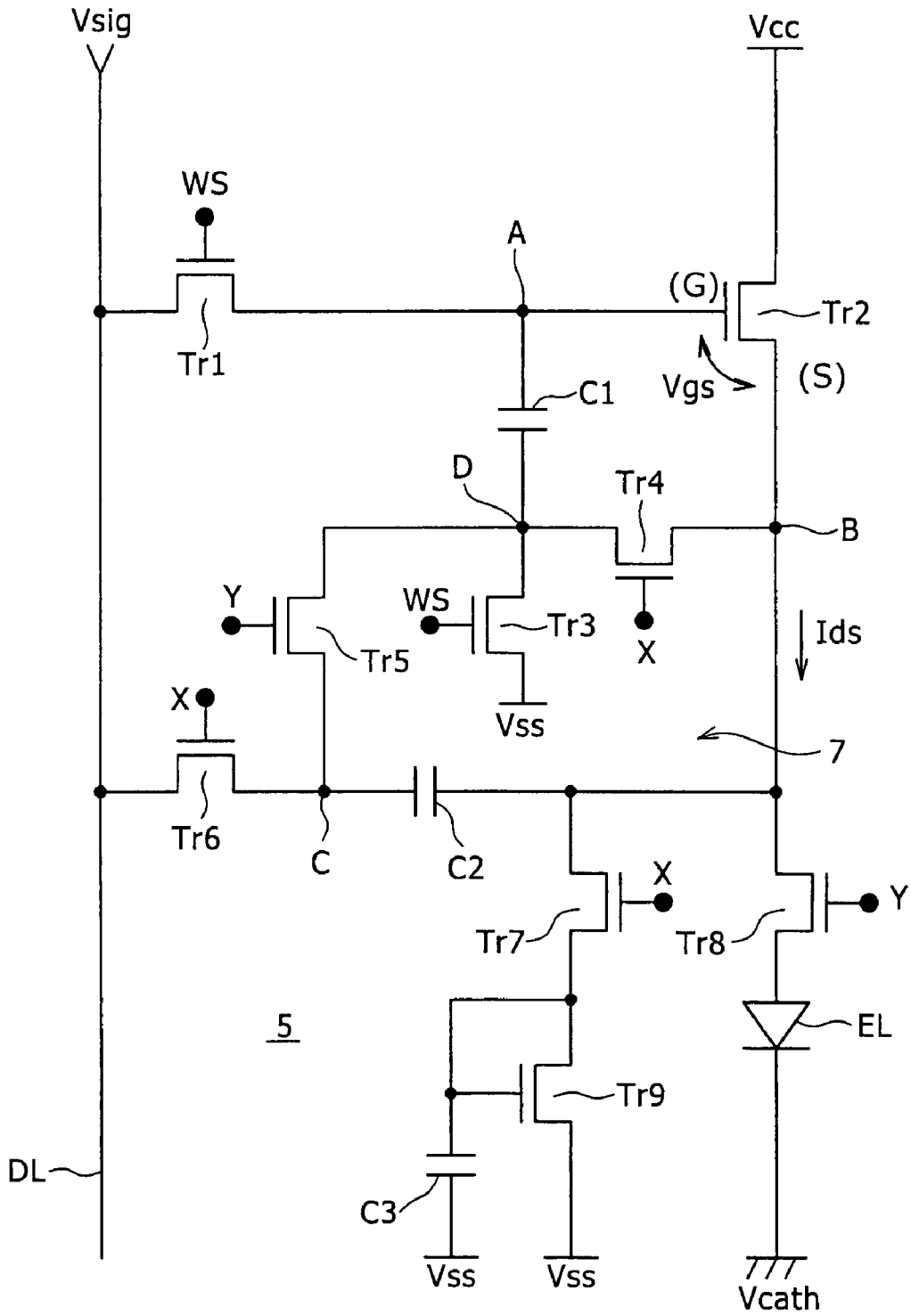
FIG. 12 is a circuit diagram showing another embodiment of a pixel circuit according to the present invention.

FIG. 12 is a schematic circuit diagram showing another embodiment of a pixel circuit according to the present invention. In order to facilitate understanding, corresponding reference numerals are used as much as possible to denote parts corresponding to those of the pixel circuit according to the reference example shown in FIG. 6. As shown in the figure, this pixel circuit 5 is disposed at a part where a scanning line and a signal line intersect each other. A signal line DL is a single line, while three scanning lines WS, X, and Y are bundled together and arranged in parallel with each other. The pixel circuit 5 includes an electrooptic element EL, a drive transistor Tr2, a sampling transistor Tr1, and a retaining capacitance C1 as fundamental components. The drive transistor Tr2 is formed by an N-channel type thin-film transistor. The drive transistor Tr2 has a gate (G) connected to an input node A, a source (S) connected to an output node B, and a drain connected to a predetermined power supply potential Vcc. Incidentally, the gate voltage of the drive transistor Tr2 is denoted by Vgs, and the drain current of the drive transistor Tr2 is denoted by Ids. The electrooptic element EL is formed by a two-terminal light emitting element such as an organic EL element or the like. The electrooptic element EL has an anode, as one terminal connected to the side of the output node B, and a cathode, as another terminal connected to a predetermined cathode potential Vcath. The sampling transistor Tr1 is connected between the input node A and the signal line DL. The gate of the sampling transistor Tr1 is connected to the scanning line WS. The retaining capacitance C1 is connected to the input node A.

In such a configuration, the sampling transistor Tr1 operates when selected by the scanning line WS, samples an input signal Vsig from the signal line DL, and retains the input signal Vsig in the retaining capacitance C1. The drive transistor Tr2 supplies a driving current (drain current Ids) to the electrooptic element EL according to the signal potential Vin retained in the retaining capacitance C1.

As a feature of the present invention, the pixel circuit 5 has a compensating circuit 7 for compensating for a decrease in the driving current (drain current Ids), which decrease is attendant on a secular change of the drive transistor Tr2. In order to detect a decrease in the drain current Ids of the drive transistor Tr2, from the side of the output node B, and feed back a result of the detection to the side of the input node A, the compensating circuit 7 includes a detecting section and feedback section. The a detecting section includes a resistive component, inserted between the output node B and a predetermined ground potential Vss, and a capacitive component for retaining, as a detection potential, a voltage drop occurring in the resistive component according to the drain current Ids flowing from the output node B to the ground potential Vss. The feedback section obtains a difference ⊿Vμ by comparing the level Vin of the input signal Vsig with the level of the detection potential and adds a potential corresponding to the difference to the signal potential Vin retained in the retaining capacitance C1.

Specifically, the compensating circuit 7, shown in FIG. 12, includes two capacitive elements C2 and C3 and seven transistors Tr3 to Tr9. The switching transistor Tr8 is inserted between the output node B and the anode of the electrooptic element EL. The switching transistor Tr7 is also connected to the output node B. The transistor Tr9 is diode-connected between the switching transistor Tr7 and the predetermined ground potential Vss. The transistor Tr9 functions as a detecting transistor. The capacitive element C3 is connected in parallel with the detecting transistor Tr9. The capacitive element C3 functions as a detecting capacitance. The diode-connected detecting transistor Tr9 corresponds to the resistive component provided in the detecting section of the compensating circuit 7. The detecting capacitance C3 corresponds to the capacitive component provided in the detecting section of the compensating circuit 7.

The other capacitive element C2 is connected between the output node B and a predetermined intermediate node C. The capacitive element C2 forms a feedback capacitance. The switching transistor Tr6 is inserted between the intermediate node C and the signal line DL. The switching transistor Tr3 is inserted between a terminal node D connected to one terminal of the retaining capacitance C1 and the predetermined ground potential Vss. The switching transistor Tr4 is inserted between the terminal node D and the output node B. The switching transistor Tr5 is inserted between the terminal node D and the intermediate node C.

As with the sampling transistor Tr1, the gate of the switching transistor Tr3 is connected to the scanning line WS. The gates of the switching transistors Tr4, Tr6, and Tr7 are each connected to the scanning line X. The gates of the switching transistors Tr5 and Tr8 are connected to the scanning line Y.

Figure 13:
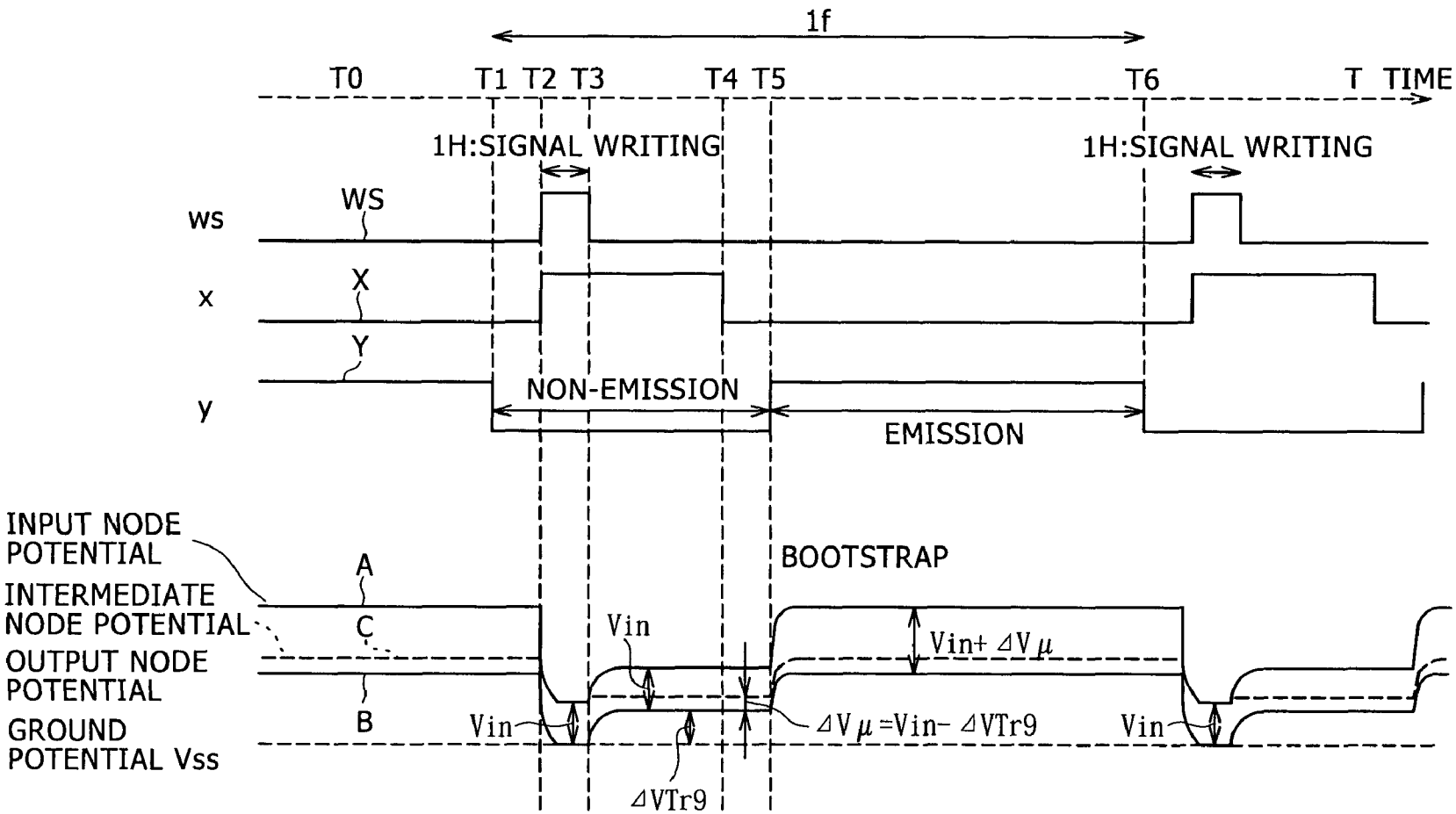
FIG. 13 is a timing chart of assistance in explaining the operation of the other embodiment shown in FIG. 12.

The operation of the pixel circuit shown in FIG. 12 will be described in detail with reference to a timing chart of FIG. 13. The timing chart of FIG. 13 shows one field (1*f*) starting in timing T1 and ending in timing T6. The waveforms of a pulse ws applied to the scanning line WS, a pulse x applied to the scanning line X, and a pulse y applied to the scanning line Y are shown along a time axis T. In addition, changes in potentials of the input node A, the intermediate node C, and the output node B are shown along the same time axis T. The change in the potential of the input node A and the change in the potential of the output node B are represented by a solid line, and the change in the potential of the intermediate node C is represented by a dotted line to be distinguished from the change in the potential of the input node A and the change in the potential of the output node B.

In timing T0, before entering the field, the scanning lines WS and X are maintained at a low level while the scanning line Y is at a high level. Therefore, the sampling transistor Tr1 and the switching transistors Tr3, Tr4, Tr6, and Tr7 are off, and only the switching transistors Tr5 and Tr8 are in an on state. At this time, as shown in the timing chart, there is a potential difference substantially equal to an input potential Vin between the potential of the input node A and the potential of the output node B, and, therefore, the drive transistor Tr2 is in an on state to supply a driving current (drain current) Ids to the light emitting element EL.

When entering the field, the scanning line Y is changed to a low level in timing T1. Thereby the switching transistors Tr5 and Tr8 are turned off. Therefore, the light emitting element EL is disconnected from the output node B and thus goes into a non-emitting state. The switching transistors Tr3 and Tr4 are also in an off state in timing T1 in addition to the switching transistor Tr5. Therefore, the terminal node D of the retaining capacitance C1 has a high impedance. The operation in timing T1 corresponds to a preparation for sampling an input signal in the field.

In timing T2, a selection pulse ws is applied to the scanning line WS, and a selection pulse x is applied to the scanning line X. The scanning line WS is thereby changed to a high level to turn on the sampling transistor Tr1 and the switching transistor Tr3. At the same time, the scanning line X is changed from a low level to a high level so that the transistors Tr4, Tr6, and Tr7 are turned on.

Since the switching transistor Tr3 is turned on, the terminal node D is connected to the ground potential Vss. Since the switching transistor Tr4 is turned on, the output node B is directly connected to the terminal node D. As a result, the potential of the output node B is sharply decreased to the ground potential Vss. At this time, since the sampling transistor Tr1 is also turned on, an input signal Vsig supplied to the signal line DL is written to the retaining capacitance C1. The magnitude of a written signal potential Vin is substantially equal to that of the voltage of the input signal Vsig. Since the terminal node D is fixed at the ground potential Vss, the potential of the input node A is precisely Vin as shown in the timing chart. This input potential Vin is applied between the gate G and the source S of the drive transistor Tr2 so that a drain current Ids corresponding to the signal potential Vin flows out from the output node B.

However, since the switching transistor Tr8 is in an off state as described above, the drain current Ids is not supplied to the light emitting element EL. The light emitting element EL, therefore, continues maintaining the non-emitting state.

When one horizontal period (1H), assigned to the operation of writing of the input signal, has passed, the selection pulse ws is cleared in timing T3 to change the scanning line WS to a low level. Thereby the N-channel type sampling transistor Tr1 is turned off, and the switching transistor Tr3 is also turned off. As a result, the input node A is disconnected from the signal line DL, and thus brought into a high-impedance state. Also, the terminal node D and the output node B are disconnected from the ground potential Vss in a state of being connected to each other. In response to this, the drive transistor Tr2 starts to supply the drain current Ids according to the signal potential Vin applied between the gate G and the source S of the drive transistor Tr2. Therefore, the potential of the output node B rises. The potential of the input node A rises by precisely the amount Vin in such a manner as to be interlocked with the potential of the output node B. At this time, since the switching transistor Tr8 remains in an off state, the drain current Ids does not flow through the electrooptic element EL, and thus the electrooptic element EL remains in the non-emitting state. Since the switching transistor Tr7 is in an on state, however, the drain current Ids flows from the output node B to the ground potential Vss via the switching transistors Tr7 and Tr9. When the drain current Ids flows through the detecting transistor, formed by the diode-connected transistor Tr9, a voltage drop ⊿VTr9 occurs according to the magnitude of the drain current Ids. This voltage drop ⊿VTr9 is sampled as a detection potential across the capacitance C3. Since the output node B is connected to the detecting capacitance C3 with the switching transistor Tr7 turned on, the potential of the output node B is at the level ⊿VTr9 as shown in the timing chart.

Meanwhile, since the switching transistor Tr6 is also in an on state, the intermediate node C is connected to the signal line DL. As a result, the intermediate node C, situated on the left side of the feedback capacitance C2, is at the signal potential Vin of the input signal Vsig. On the other hand, the output node B on the right side of the feedback capacitance C2 is at the potential ⊿VTr9, as described above. Hence, a potential difference ⊿Vμ=Vin−⊿VTr9 occurs across the feedback capacitance C2. The feedback capacitance C2 thus obtains the difference ⊿Vμ by comparing the level Vin of the input signal Vsig with the level of the above-described detection potential ⊿VTr9. The detection potential ⊿VTr9 represents the voltage drop according to the drain current Ids. Therefore, when the mobility or the like of the drive transistor Tr2 is decreased, due to degradation of the drive transistor Tr2 with the passage of time and thus the drain current Ids is reduced, the detection potential ⊿VTr9 is also decreased. When the detection potential ⊿VTr9 is decreased, the difference ⊿Vμ is conversely increased. By feeding back the difference ⊿Vμ to the side of the input node A, the reduction in the drain current Ids can be cancelled. Even when a degradation of the drive transistor Tr2 with the passage of time lowers the capability of supplying the drain current Ids, the driving current having the same level as that of an initial drain current can be ensured by this feedback operation.

Thereafter, in timing T4, the selection pulse x is cleared to change the scanning line X to a low level. The switching transistors Tr4, Tr6 and Tr7 are thereby turned off. The feedback capacitance C2 is disconnected from the signal line DL and the ground potential Vss and retains the above-described difference ⊿Vμ.

Thereafter, in timing T5, a selection pulse y is applied to change the scanning line Y from a low level to a high level. The switching transistors Tr5 and Tr8 are thereby turned on. By turning on the switching transistor Tr8, the anode of the electrooptic element EL is directly connected to the output node B. By turning on the switching transistor Tr5, the intermediate node C is directly connected to the terminal node D. The difference ⊿Vμ retained by the C2 as well as the signal potential Vin retained by the C1 is applied between the input node A and the output node B. The drive transistor Tr2 supplies a drain current Ids corresponding to Vin+⊿Vμ to the light emitting element EL whereby light emission is started. Due to a voltage drop occurring in the light emitting element EL, the potential of the output node B is increased. The potential of the input node A is also increased in such a manner as to be interlocked with the potential of the output node B. This bootstrap operation maintains a potential difference between the input node A and the output node B at the value of Vin+⊿Vμ. As described above, when the drain current Ids is decreased, due to degradation of the drive transistor Tr2, the difference ⊿Vμ is increased so as to compensate for the decrease. This feedback operation suppresses the variation in the drain current Ids so that the drain current Ids, having the same level as an initial level, can be made to flow irrespective of change in the mobility μ of the drive transistor Tr2.

Thereafter, in timing T6, the scanning line Y falls to a low level to turn off the switching transistor Tr8, whereby the light emission is ended. Thereby a series of operations in the field is completed, and a next field is started.

Thus, the compensating circuit, according to the present embodiment of the present invention, employs a detecting section including a resistive component, inserted between the output node and the ground potential, and a capacitive component, for retaining, as a detection potential, a voltage drop occurring in the resistive component according to the driving current flowing from the output node to the ground potential. Since the voltage drop occurring in the resistive component is detected, the detection itself takes only a short time, and there is a sufficient timing margin. On the other hand, it is possible to employ a detecting section for accumulating charge carried by the driving current for a certain period of time and outputting a detection potential corresponding to an amount of charge accumulated. However, a system using a detection potential corresponding to an amount of charge accumulated requires a predetermined time for charge accumulation, and may, therefore, squeeze a timing margin in the entire sequence. For comparison, the system using a detection potential corresponding to an amount of charge accumulated will be described in the following with reference to FIGS. 10 and 11.

FIG. 10 is a schematic circuit diagram showing an embodiment of a pixel circuit according to a comparison example. In order to facilitate understanding, corresponding reference numerals are used as much as possible to denote parts corresponding to those of the pixel circuit according to the embodiment of the present invention shown in FIG. 12. As shown in the figure, this pixel circuit 5 is disposed at a part where a scanning line and a signal line intersect each other. A signal line DL is a single line, while three scanning lines WS, X, and Y are bundled together and arranged in parallel with each other. The pixel circuit 5 includes an electrooptic element EL, a drive transistor Tr2, a sampling transistor Tr1, and a retaining capacitance C1 as fundamental components. The drive transistor Tr2 is formed by an N-channel type thin-film transistor. The drive transistor Tr2 has a gate (G) connected to an input node A, a source (S) connected to an output node B, and a drain connected to a predetermined power supply potential Vcc. Incidentally, the gate voltage of the drive transistor Tr2 is denoted by Vgs, and the drain current of the drive transistor Tr2 is denoted by Ids. The electrooptic element EL is formed by a two-terminal light emitting element such as an organic EL element or the like. The electrooptic element EL has an anode as one terminal connected to the side of the output node B, and a cathode as another terminal connected to a predetermined cathode potential Vcath. The sampling transistor Tr1 is connected between the input node A and the signal line DL. The gate of the sampling transistor Tr1 is connected to the scanning line WS. The retaining capacitance C1 is connected to the input node A.

In such a configuration, the sampling transistor Tr1 operates when selected by the scanning line WS, samples an input signal Vsig from the signal line DL, and retains the input signal Vsig in the retaining capacitance C1. The drive transistor Tr2 supplies a driving current (drain current Ids) to the electrooptic element EL according to the signal potential Vin retained in the retaining capacitance C1.

As a feature of the comparison example, the pixel circuit 5 has a compensating circuit 7 for compensating for a decrease in the driving current (drain current Ids) which decrease is attendant on a secular change of the drive transistor Tr2. This compensating circuit 7 detects a decrease in the driving current (drain current Ids) of the drive transistor Tr2, from the side of the output node B, and feeds back a result of the detection to the side of the input node A. For this purpose, the compensating circuit 7 includes a detecting section, for accumulating charge carried by the drain current Ids for a certain period of time and outputting a detection potential corresponding to an amount of charge accumulated, and a feedback section, for obtaining a difference $\Delta V\mu$ by comparing the level Vin of the input signal Vsig with the level of the detection potential and adding a potential corresponding to the difference to the signal potential Vin retained in the retaining capacitance C1.

Specifically, the compensating circuit 7 includes six transistors Tr3 to Tr8 and two capacitances C2 and C3. The switching transistor Tr8 is inserted between the output node B and the electrooptic element EL. The switching transistor Tr7 is also connected to the output node B. The detecting capacitance C3 is connected between the switching transistor Tr7 and a predetermined ground potential Vss. The switching transistors Tr7 and Tr8 and the detecting capacitance C3 form the above-described detecting section of the compensating circuit 7.

The feedback capacitance C2 is connected between the output node B and a predetermined intermediate node C. The switching transistor Tr6 is inserted between the intermediate node C and the signal line DL. The switching transistor Tr3 is inserted between a terminal node D connected to one terminal of the retaining capacitance C1 and the predetermined ground potential Vss. The switching transistor Tr4 is inserted between the terminal node D and the output node B. The switching transistor Tr5 is inserted between the terminal node D and the intermediate node C. The feedback capacitance C2 and the switching transistors Tr5 and Tr6 form the above-described feedback section of the compensating circuit 7.

The gate of the switching transistor $Tr^1$ is connected to the scanning line WS. The gates of the switching transistors Tr4, Tr6, and Tr7 are connected to another scanning line X. The switching transistors Tr5 and Tr8 are connected to yet another scanning line Y.

The operation of the pixel circuit shown in FIG. 10 will be described in detail with reference to a timing chart of FIG. 11. The timing chart of FIG. 11 shows one field (1*f*) starting in timing T1 and ending in timing T6. The waveforms of a pulse ws applied to the scanning line WS, a pulse x applied to the scanning line X, and a pulse y applied to the scanning line Y are shown along a time axis T. In addition, changes in potentials of the input node A, the intermediate node C, and the output node B are shown along the same time axis T. The change in the potential of the input node A and the change in the potential of the output node B are represented by a solid line, and the change in the potential of the intermediate node C is represented by a dotted line to be distinguished from the change in the potential of the input node A and the change in the potential of the output node B.

In timing T0, before entering the field, the scanning lines WS and X are maintained at a low level while the scanning line Y is at a high level. Therefore, the sampling transistor Tr1 and the switching transistors Tr3, Tr4, Tr6, and Tr7 are off, and only the switching transistors Tr5 and Tr8 are in an on state. At this time, as shown in the timing chart, there is a potential difference substantially equal to an input potential Vin between the potential of the input node A and the potential of the output node B; therefore, the drive transistor Tr2 is in an on state to supply a driving current (drain current) Ids to the light emitting element EL.

When entering the field, the scanning line Y is changed to a low level in timing T1. Thereby the switching transistors Tr5 and Tr8 are turned off. Therefore, the light emitting element EL is disconnected from the output node B and thus goes into a non-emitting state. The switching transistors Tr3 and Tr4 are also in an off state in timing T1 in addition to the switching transistor Tr5. Therefore, the terminal node D of the retaining capacitance C1 has a high impedance. The operation in timing T1 corresponds to a preparation for sampling an input signal in the field.

In timing T2, a selection pulse ws is applied to the scanning line WS and a selection pulse x is applied to the scanning line X. The scanning line WS is thereby changed to a high level to turn on the sampling transistor Tr1 and the switching transistor Tr3. At the same time, the scanning line X is changed from a low level to a high level so that the transistors Tr4, Tr6, and Tr7 are turned on.

Since the switching transistor Tr3 is turned on, the terminal node D is connected to the ground potential Vss. Since the switching transistor Tr4 is turned on, the output node B is directly connected to the terminal node D. As a result, the potential of the output node B is sharply decreased to the ground level Vss. At this time, since the sampling transistor Tr1 is also turned on, an input signal Vsig supplied to the signal line DL is written to the retaining capacitance C1. The magnitude of a written signal potential Vin is substantially equal to that of the voltage of the input signal Vsig. Since the terminal node D is fixed at the ground potential Vss, the potential of the input node A is precisely Vin as shown in the timing chart. This input potential Vin is applied between the gate G and the source S of the drive transistor Tr2 so that a drain current Ids, corresponding to the signal potential Vin, flows out from the output node B.

However, since the switching transistor Tr8 is in an off state as described above, the drain current Ids is not supplied to the light emitting element EL. The light emitting element EL, therefore, continues maintaining the non-emitting state.

When one horizontal period (1H), assigned to the operation of writing of the input signal, has passed the selection pulse ws is cleared in timing T3 to return the scanning line WS from a high level to a low level. Thereby the sampling transistor Tr1 and the switching transistor Tr3 are turned off. As a result, the terminal node D and the output node B are disconnected from the ground potential Vss. In response to this, the potential of the output node B starts to rise, and the drain current Ids starts to flow into the detecting capacitance C3 via the switching transistor Tr7 in an on state. With accumulation of charge, the potential of the output node B continues rising. At this time, since the terminal node D is disconnected from the ground potential Vss, the potential of the input node A rises in such a manner as to be interlocked with the potential of the output node B. A potential difference Vin between the input node A and the output node B is kept constant.

In timing T4, after the passage of a predetermined time t from timing T3, the selection pulse x is cleared to return the scanning line X from a high level to a low level. The transistors Tr4, Tr7 and Tr6 are thereby turned off. In a stage in which the switching transistor Tr7 is turned off, the charge accumulation of the detecting capacitance C3 is completed. The potential of the detecting capacitance C3 which potential corresponds to the accumulated charge is given by $\Delta VC3=(Ids/C3)\cdot t$. As is clear from this equation, the detection potential $\Delta VC3$ is proportional to the drain current Ids because the capacitance value C3 and the accumulation time t are fixed. That is, the detection potential $\Delta VC3$ has a value proportional to the drain current Ids of the drive transistor Tr2. As the mobility p of the drive transistor Tr2 is decreased with the passage of time, the detection potential $\Delta VC3$ is correspondingly lowered.

The switching transistors Tr6 and Tr7 are in an on state until immediately before the scanning line X falls to a low level in timing T4. The feedback capacitance C2 is therefore at the potential Vin of the input signal Vsig on the side of the intermediate node C. The potential of the feedback capacitance C2 on the side of the output node B is precisely $\Delta VC3$. Hence, when the selection pulse x is cleared and the switching transistors Tr6 and Tr7 are thereby turned off, the feedback capacitance C2 holds a potential $\Delta V\mu$ corresponding to a difference between the potential Vin and the detection potential $\Delta VC3$. That is, the potential $\Delta V\mu$ is expressed by $\Delta V\mu=Vin-\Delta VC3$. As described above, when the drain current Ids is decreased, due to degradation of the drive transistor Tr2, the detection potential $\Delta VC3$ is also decreased. Hence, the potential $\Delta V\mu$ is increased. By feeding back the potential $\Delta V\mu$, held by the feedback capacitance C2 to the side of the input node A, it is possible to cancel the decrease in the drain current Ids. This feedback operation makes it possible to continue supplying the drain current Ids having the same level as an initial level even when a degradation occurs in an operation characteristic of the drive transistor Tr2 such as mobility or the like.

The comparison example compares and determines the magnitude of the detection potential $\Delta VC3$ with the signal potential Vin of the input signal Vsig as a reference. The signal potential Vin varies in a predetermined range (for example 0 to 5 V). The drain current Ids correspondingly varies, and the detection potential $\Delta VC3$ has a corresponding level. The signal potential Vin and the detection potential $\Delta VC3$ thus change in the same direction so that dynamic comparison is possible. As a precondition, the dynamic range of the signal potential Vin and the dynamic range of the detection potential $\Delta VC3$ need to substantially match each other. Supposing that the dynamic range of the signal potential Vin is 0 to 5 V as described above, it is desirable that the detection potential $\Delta VC3$ vary in substantially a range of 0 to 5 V. In order to set the dynamic range of the detection potential $\Delta VC3$ to the desired range, it is necessary to set the accumulation time t and the capacitance of the detecting capacitance C3 appropriately.

Thereafter, in timing T5, a selection pulse y is applied to change the scanning line Y from a low level to a high level. The switching transistors Tr5 and Tr8 are thereby turned on. By turning on the switching transistor Tr8, the anode of the electrooptic element EL is directly connected to the output node B. By turning on the switching transistor Tr5, the intermediate node C is directly connected to the terminal node D. The difference $\Delta V\mu$, retained by the detecting capacitance C2, as well as the signal potential Vin, retained by the retaining capacitance C1, is applied between the input node A and the output node B. The drive transistor Tr2 supplies a drain current Ids corresponding to $Vin+\Delta V\mu$ to the light emitting element EL, whereby light emission is started. Due to a voltage drop occurring in the light emitting element EL, the potential of the output node B is increased. The potential of the input node A is also increased in such a manner as to be interlocked with the potential of the output node B. This bootstrap operation maintains a potential difference between the input node A and the output node B at the value of $Vin+\Delta V\mu$. As described above, when the drain current Ids is decreased, due to degradation of the drive transistor Tr2, the difference $\Delta V\mu$ is increased so as to compensate for the decrease. This feedback operation suppresses the variation in the drain current Ids so that the drain current Ids, having the same level as an initial level, can be made to flow irrespective of change in the mobility p of the drive transistor Tr2.

Thereafter, in timing T6, the scanning line Y falls to a low level to turn off the switching transistor Tr8, whereby the light emission is ended. Thereby a series of operations in the field is completed, and a next field is started.

Figure 14:
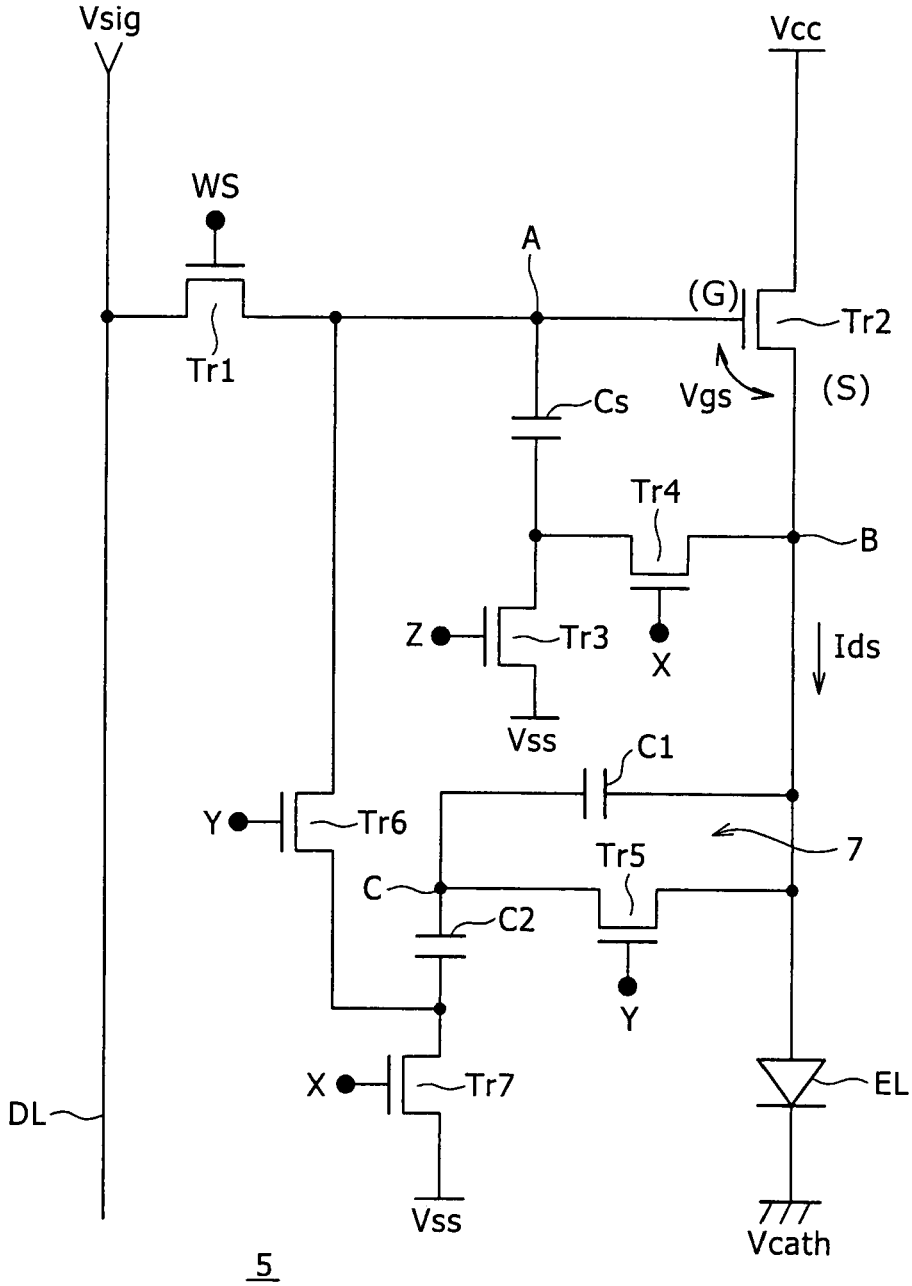
FIG. 14 is a circuit diagram showing another embodiment of a pixel circuit according to the present invention.

FIG. 14 is a schematic circuit diagram showing another embodiment of a pixel circuit according to the present invention. In order to facilitate understanding, corresponding reference numerals are used as much as possible to denote parts corresponding to those of the pixel circuit according to the reference example shown in FIG. 6. As shown in the figure, this pixel circuit 5 is disposed at a part where a scanning line and a signal line intersect each other. A signal line DL is a single line, while four scanning lines WS, X, Y, and Z are bundled together and arranged in parallel with each other. The pixel circuit 5 includes a light emitting element EL, a drive transistor Tr2, a sampling transistor Tr1, and a retaining capacitance Cs as fundamental components. The drive transistor Tr2 has a gate G connected to an input node A, a source S connected to an output node B, and a drain connected to a predetermined power supply potential Vcc. The light emitting element EL is, for example, a diode type, two-terminal element such as an organic EL element or the like. The light emitting element EL has an anode, as one terminal connected to the output node B, and a cathode, as another terminal connected to a predetermined potential Vcath. The sampling transistor Tr1 is connected between the input node A and the signal line DL. The gate of the sampling transistor Tr1 is connected to the scanning line WS. The retaining capacitance Cs is connected to the input node A. In such a configuration, the sampling transistor Tr1 operates when selected by the scanning line WS, samples an input signal Vsig from the signal line DL, and retains the input signal Vsig in the retaining capacitance Cs. The drive transistor Tr2 supplies a driving current to the light emitting element EL according to the signal potential retained in the retaining capacitance Cs. In the example shown in the figure, the drive transistor Tr2 outputs a drain current Ids from the output node B, and supplies the drain current Ids as the driving current to the light emitting element EL. The light emitting element EL emits light with a voltage drop occurring according to the driving current Ids.

As a feature of the present invention, the pixel circuit 5 incorporates a compensating circuit 7 for compensating for a decrease in brightness due to a secular change of the light emitting element EL. This compensating circuit 7 detects the voltage drop increasing according to the secular change of the light emitting element EL from the side of the output node B, and feeds back a signal potential corresponding to the level of the detected voltage drop to the side of the input node A. The drive transistor Tr2 supplies the sufficient drain current Ids to compensate for a decrease in brightness of the light emitting element EL according to the fed-back signal potential. Thus, the present invention directs attention to a tendency for the voltage drop to increase as the brightness is degraded as a general tendency of the light emitting element and compensates for a decrease in the brightness of the light emitting element with the passage of time utilizing this tendency. That is, as the brightness is degraded, the voltage drop within the light emitting element EL increases. This voltage drop is detected and fed back to the side of the input node as a signal potential, whereby the degradation in the brightness is made up for. That is, as the brightness is degraded, the voltage drop increases. This voltage drop is fed back to the drive transistor, whereby the driving current is increased. This increase in the driving current always acts in a direction to make up for degradation in the brightness.

As for a concrete configuration, the compensating circuit 7 includes two detecting capacitances C1 and C2 and five switching transistors Tr3 to Tr7. The two detecting capacitances C1 and C2 are connected in series with each other between the output node B and the input node A. In the figure, a point of interconnection between the two detecting capacitances C1 and C2 is indicated by an intermediate node C. The two detecting capacitances C1 and C2, connected in series with each other, detect the voltage drop occurring in the light emitting element EL from the side of the output node B, and each retain the voltage drop according to a capacitance dividing ratio. Also, the level of an amount of the voltage drop, which amount is retained by the detecting capacitance C2, situated on the side of the input node A, is fed back as a signal potential to the side of the input node A.

The five switching transistors Tr3 to Tr7 are arranged to operate the two detecting capacitances C1 and C2 in the above-described sequence. The switching transistors Tr3 to Tr7 are controlled to be turned on/off by corresponding scanning lines. Specifically, the switching transistor Tr5 is inserted in parallel with one of the two detecting capacitances C1 and C2 connected in series with each other that is situated on the side of the output node B, that is, the detecting capacitance C1. In other words, the switching transistor Tr5 is connected between the output node B and the intermediate node C. The gate of the switching transistor Tr5 is connected to the scanning line Y. The switching transistor Tr7 is inserted between the other detecting capacitance C2, situated on the side of the input node A, and a predetermined ground potential Vss. The gate of the switching transistor Tr7 is connected to the scanning line X. The switching transistor Tr6 is inserted between the other detecting capacitance C2, situated on the side of the input node A, and the input node A. The gate of the switching transistor Tr6 is connected to the scanning line Y. The switching transistor Tr3 is inserted between the retaining capacitance Cs and the predetermined ground potential Vss. The gate of the switching transistor Tr3 is connected to the scanning line Z. The other switching transistor Tr4 is inserted between the retaining capacitance Cs and the output node B. The gate of the switching transistor Tr4 is connected to the scanning line X.

Figure 15:
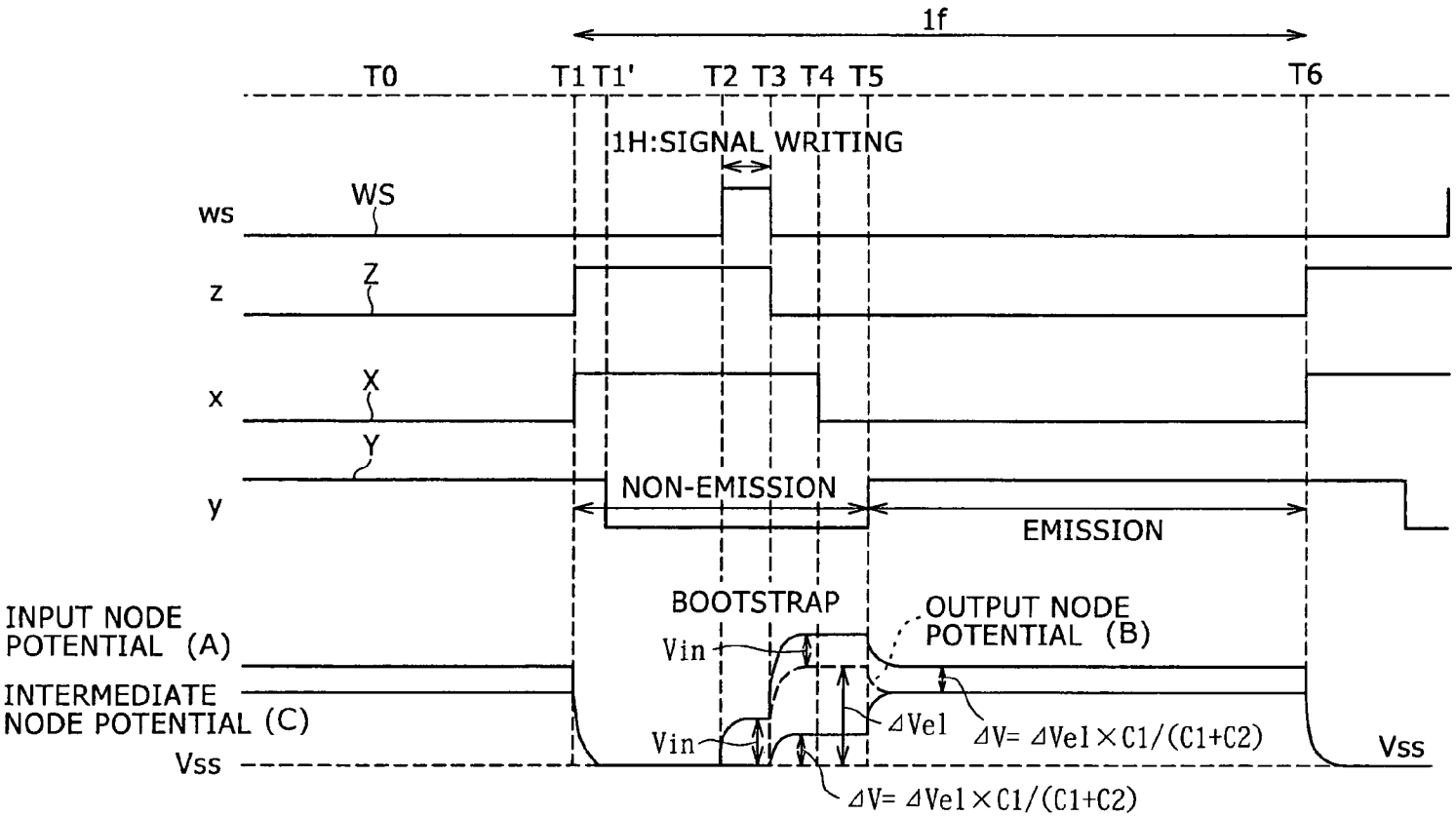
FIG. 15 is a timing chart of assistance in explaining the operation of the other embodiment shown in FIG. 14.

The operation of the pixel circuit shown in FIG. 14 will be described in detail with reference to a timing chart of FIG. 15. The timing chart of FIG. 15 shows one field (1*f*) starting in timing T1 and ending in timing T6. The waveforms of a pulse ws, applied to the scanning line WS, a pulse x, applied to the scanning line X, a pulse y, applied to the scanning line Y, and a pulse z, applied to the scanning line Z, are shown along a time axis T. In addition, changes in potentials of the input node A, the intermediate node C, and the output node B are shown along the same time axis T. The change in the potential of the input node A and the change in the potential of the intermediate node C are represented by a solid line, and the change in the potential of the output node B is represented by a chain line to be distinguished from the change in the potential of the input node A and the change in the potential of the intermediate node C. In timing T0, before entering the field, the scanning lines WS, Z, and X are at a low level, while the scanning line Y is at a high level. Therefore, the sampling transistor Tr1 and the switching transistors Tr3, Tr4, and Tr7 are off, while the switching transistors Tr5 and Tr6 are in an on state.

Entering the field in question from the above-described state in a previous field, the scanning lines Z and X rise from a low level to a high level in timing T1. Thereby the switching transistors Tr3, Tr4, and Tr7 are turned on. Therefore, the switching transistors Tr3 to Tr7, included in the pixel circuit 5, are all turned on. Hence, the terminals of the retaining capacitance Cs and the detecting capacitances C1 and C2 are all short-circuited, and thus all of charge stored in the previous field is discharged. Therefore, in timing T1, the charge of the retaining capacitance Cs and the detecting capacitances C1 and C2 are cleared, and thus the retaining capacitance Cs and the detecting capacitances C1 and C2 are reset to be ready for new operation in the field in question.

Since all the switching transistors Tr3 to Tr7 conduct, the input node A, the output node B, and the intermediate node C are decreased to the ground potential Vss. A potential difference between the input node A and the output node B becomes zero. Thus, the drain current Ids does not flow through the drive transistor Tr2 so that the light emitting element EL is put in a non-emitting state.

In timing T1', after the passage of a short time from timing T1, the scanning line Y is changed from a high level to a low level, and the switching transistors Tr5 and Tr6 are thereby turned off. Therefore, the detecting capacitances C1 and C2, connected in series with each, other are disconnected from the side of the input node A to be put in a standby state for voltage drop detection to be performed later.

In timing T2, a selection pulse ws is applied to the scanning line WS, and the sampling transistor Tr1 is thereby turned on. Thus, an input signal Vsig, supplied from the signal line DL, is sampled into the retaining capacitance Cs, and a signal potential Vin is retained in the retaining capacitance Cs. That is, the potential of the input node A becomes precisely the signal potential Vin with the ground potential Vss as a reference. The signal potential Vin is applied between the input node A and the output node B; accordingly, the drive transistor Tr2 starts to pass the drain current Ids.

When one horizontal period (1H), assigned to the sampling of the input signal Vsig, has passed the selection pulse ws is cleared in timing T3 to return the sampling transistor Tr1 to an off state. At the same time, the scanning line Z is changed from a high level to a low level to turn off the switching transistor Tr3 so that the retaining capacitance Cs and the output node B are disconnected from the ground potential Vss. The drain current Ids, supplied from the drive transistor Tr2, flows into the light emitting element EL; accordingly, a voltage drop ⊿Vel occurs. The potential of the output node B rises by the amount of this voltage drop ⊿Vel with respect to the ground potential Vss. At this time, since the retaining capacitance Cs is disconnected from the ground potential Vss, the potential of the input node A is also raised in such a manner as to be interlocked with the potential of the output node B by bootstrap operation. At this time, the potential difference Vin between the input node A and the output node B is maintained at a constant value by the bootstrap operation.

In timing T3, the switching transistor Tr5 is in an off state, while the switching transistor Tr7 is in an on state. Therefore, the pair of detecting capacitances C1 and C2 is connected in series with each other between the output node B and the ground potential Vss. The drain current Ids, supplied from the output node B, also flows into the detecting capacitances C1 and C2, connected in series with each other, and the voltage drop ⊿Vel, appearing at the output node B, is precisely retained by the two detecting capacitances C1 and C2, according to the capacitance dividing ratio between the detecting capacitances C1 and C2. A voltage drop component ⊿V, retained in the detecting capacitance C2, is ⊿V=⊿Vel×C1/(C1+C2), according to the capacitance dividing ratio. This voltage drop component ⊿V appears precisely as the potential of the intermediate node C, with respect to the ground potential Vss in the timing chart of FIG. 15. Thus, by capacitive coupling, the detecting capacitance C2 retains the signal potential ⊿V according to the voltage drop ⊿Vel of the light emitting element EL.

Next, in timing T4, the scanning line X is returned to a low level, whereby the switching transistors Tr4 and Tr7 are turned off. As a result, the retaining capacitance Cs is disconnected from the output node B, and the detecting capacitance C2 is disconnected from the ground potential Vss.

Further, in timing T5, the scanning line Y is changed from a low level to a high level, whereby the switching transistors Tr5 and Tr6 are turned on. Thus, the detecting capacitance C2 is directly connected between the output node B and the input node A. The signal potential ⊿V, retained in the detecting capacitance C2, is, therefore, applied between the input node A and the output node B. The drive transistor Tr2 supplies a drain current Ids to the light emitting element EL according to the signal potential ⊿V. The light emitting element EL is thereby brought into a light emitting state to display an image. As shown in the timing chart of FIG. 15, the signal voltage ⊿V applied after timing T5 is represented as ⊿Vel×C1/(C1+C2). As described above, as the brightness of the light emitting element EL is decreased with the passage of time, the voltage drop ⊿Vel is increased. The signal voltage ⊿V is proportional to the voltage drop ⊿Vel with a proportionality constant C1/(C1+C2). This signal voltage ⊿V is fed back to the side of the input node A. Thus, as the voltage drop ⊿Vel is increased, the drain current Ids is increased to compensate for the decrease in the brightness of the light emitting element EL.

Thereafter, in timing T6, the scanning lines Z and X are returned to a high level, whereby all the switching transistors Tr3 to Tr7 are turned on to perform a reset operation in preparation for a next frame.

It should be understood by those skilled in the art that various modifications, combinations, sub-combinations and alterations may occur depending on design requirements and other factors insofar as they are within the scope of the appended claims or the equivalents thereof.

What is claimed is:

1. A pixel circuit disposed at a part where a scanning line and a signal line intersect each other, said pixel circuit comprising:

an electrooptic element;

a drive transistor;

a sampling transistor;

a retaining capacitance;

said drive transistor having a gate connected to an input node, a source connected to an output node, and a drain connected to a predetermined power supply potential;

said electrooptic element having one terminal connected to said output node and another terminal connected to a predetermined potential;

said sampling transistor being connected between said input node and said signal line;

said retaining capacitance being connected to said input node;

said sampling transistor operating when selected by said scanning line, sampling an input signal from said signal line, and retaining the input signal in said retaining capacitance;

said drive transistor supplying a driving current to said electrooptic element according to a signal potential retained in said retaining capacitance; and a compensating circuit for compensating for a decrease in said driving current which decrease is attendant on a secular change of said drive transistor;

said compensating circuit detecting a decrease in said driving current from a side of said output node, and feeding back a result of detection to a side of said input node.

wherein said compensating circuit detects a voltage drop occurring in said electrooptic element according to said driving current from the side of said output node, obtains a difference by comparing a level of said input signal with a level of the detected voltage drop, and adds a potential corresponding to said difference to said signal potential retained in said retaining capacitance.

2. A pixel circuit disposed at a part where a scanning line and a signal line intersect each other, said pixel circuit comprising:

an electrooptic element;

a drive transistor;

a sampling transistor;

a retaining capacitance;

said drive transistor having a gate connected to an input node, a source connected to an output node, and a drain connected to a predetermined power supply potential;

said electrooptic element having one terminal connected to said output node and another terminal connected to a predetermined potential;

said sampling transistor being connected between said input node and said signal line;

said retaining capacitance being connected to said input node;

said sampling transistor operating when selected by said scanning line, sampling an input signal from said signal line, and retaining the input signal in said retaining capacitance;

said drive transistor supplying a driving current to said electrooptic element according to a signal potential retained in said retaining capacitance; and a compensating circuit for compensating for a decrease in said driving current which decrease is attendant on a secular change of said drive transistor;

said compensating circuit detecting a decrease in said driving current from a side of said output node, and feeding back a result of detection to a side of said input node.

wherein said compensating circuit includes:

a detecting capacitance connected between said output node and a predetermined intermediate node;

a switching transistor inserted between said intermediate node and said signal line;

a switching transistor inserted between a terminal node connected to one terminal of said retaining capacitance and a predetermined ground potential;

a switching transistor inserted between said terminal node and said output node; and a switching transistor inserted between said terminal node and said intermediate node.

3. A display device comprising:

scanning lines in a form of rows;

signal lines in a form of columns; and pixel circuits arranged in a form of a matrix at parts where said scanning lines intersect said signal lines;

said pixel circuits each including at least an electrooptic element, a drive transistor, a sampling transistor, and a retaining capacitance;

said drive transistor having a gate connected to an input node, a source connected to an output node, and a drain connected to a predetermined power supply potential;

said electrooptic element having one terminal connected to said output node and another terminal connected to a predetermined potential;

said sampling transistor being connected between said input node and said signal line;

said retaining capacitance being connected to said input node;

said sampling transistor operating when selected by said scanning line, sampling an input signal from said signal line, and retaining said input signal in said retaining capacitance;

said drive transistor supplying a driving current to said electrooptic element according to a signal potential retained in said retaining capacitance, whereby display is made;

said pixel circuit further including a compensating circuit for compensating for a decrease in said driving current which decrease is attendant on a secular change of said drive transistor;

said compensating circuit detecting a decrease in said driving current from a side of said output node, and feeding back a result of detection to a side of said input node, wherein said compensating circuit detects a voltage drop occurring in said electrooptic element according to said driving current from the side of said output node, obtains a difference by comparing a level of said input signal with a level of the detected voltage drop, and adds a potential corresponding to said difference to said signal potential retained in said retaining capacitance.

4. A display device comprising:

scanning lines in a form of rows;

signal lines in a form of columns; and pixel circuits arranged in a form of a matrix at parts where said scanning lines intersect said signal lines;

said pixel circuits each including at least an electrooptic element, a drive transistor, a sampling transistor, and a retaining capacitance;

said drive transistor having a gate connected to an input node, a source connected to an output node, and a drain connected to a predetermined power supply potential;

said electrooptic element having one terminal connected to said output node and another terminal connected to a predetermined potential;

said sampling transistor being connected between said input node and said signal line;

said retaining capacitance being connected to said input node;

said sampling transistor operating when selected by said scanning line, sampling an input signal from said signal line, and retaining said input signal in said retaining capacitance;

said drive transistor supplying a driving current to said electrooptic element according to a signal potential retained in said retaining capacitance, whereby display is made;

said pixel circuit further including a compensating circuit for compensating for a decrease in said driving current which decrease is attendant on a secular change of said drive transistor;

said compensating circuit detecting a decrease in said driving current from a side of said output node, and feeding back a result of detection to a side of said input node;

wherein said compensating circuit includes:

a detecting capacitance connected between said output node and a predetermined intermediate node;

a switching transistor inserted between said intermediate node and said signal line;

a switching transistor inserted between a terminal node connected to one terminal of said retaining capacitance and a predetermined ground potential;

a switching transistor inserted between said terminal node and said output node; and a switching transistor inserted between said terminal node and said intermediate node.

* * * * *